United States Patent [19]

Englehardt et al.

[11] Patent Number: 5,020,794

[45] Date of Patent: Jun. 4, 1991

[54] MOTOR CONTROL FOR AN EXERCISE MACHINE SIMULATING A WEIGHT STACK

[75] Inventors: William H. Englehardt, Wood Dale; Olgerts J. Svilans, Chicago, both of Ill.; Augustine Nieto, Newport Beach, Calif.

[73] Assignee: Bally Manufacturing Corporation, Chicago, Ill.

[21] Appl. No.: 204,665

[22] Filed: Jun. 10, 1988

Related U.S. Application Data

[63] Continuation-in-part of Ser. No. 4,006, Jan. 16, 1987, abandoned.

[51] Int. Cl.[5] ..... A63B 21/005

[52] U.S. Cl. ..... 272/129; 272/125; 272/DIG. 5; 272/DIG. 6; 73/379

[58] Field of Search ..... 272/73, 129, 130, 134, 272/DIG. 6, DIG. 5, 116–118, 125; 128/25 R; 73/862.18, 379

[56] References Cited

U.S. PATENT DOCUMENTS

| | | | |
|---|---|---|---|
| 3,848,467 | 11/1974 | Flavell | 272/129 X |
| 4,060,239 | 11/1977 | Pfleiderer et al. | 272/73 |
| 4,184,678 | 1/1980 | Flavell et al. | 272/129 |
| 4,323,237 | 4/1982 | Jungerwirth | 73/379 X |
| 4,333,340 | 6/1982 | Elmeskog | 73/379 |
| 4,354,676 | 10/1982 | Ariel | 272/129 |
| 4,493,485 | 1/1985 | Jones | 272/126 |
| 4,544,154 | 10/1985 | Ariel | 272/129 |
| 4,563,003 | 1/1986 | Bugallo | 272/118 |
| 4,569,518 | 2/1986 | Fulks | 272/129 |
| 4,601,468 | 7/1986 | Bond et al. | 272/130 |
| 4,678,182 | 7/1987 | Nakao et al. | 272/129 X |
| 4,691,694 | 9/1987 | Boyd et al. | 128/25 |
| 4,778,175 | 10/1988 | Wucherpfenning et al. | 272/129 |
| 4,828,257 | 5/1989 | Dyer et al. | 272/129 |

FOREIGN PATENT DOCUMENTS

| | | |
|---|---|---|
| 2581552 | 11/1986 | France . |
| 2157578 | 10/1985 | United Kingdom . |

*Primary Examiner*—Richard J. Apley
*Assistant Examiner*—Joe H. Cheng
*Attorney, Agent, or Firm*—Jenner & Block

[57] ABSTRACT

In an exercise machine where an electric motor is used to simulate a weight stack a more realistic feel plus stability of operation is achieved by compensating the torque output of the motor for the mechanical characteristics of the machine including inertia, friction and gravitational effects on the user interface. Also by controlling the motor so as to increase its output torque as a function of the displacement of the user interface, it is possible to produce a measure of the user's strength. A heavy negative feature which may be selected by the user is provided as well. The exercise machine additionally includes a computer control which allows a pyramid type exercise program to be implemented. The pyramid exercise program has a progressive phase in which the force opposing the user is increased from a starting level to a plateau level over a first group of repetitions; a plateau phase in which the force opposing the user is maintained constant over a second group of repetitions; and a regressive phase in which the force opposing the user is decreased from the plateau level to the starting level over a second group of repetitions. The exercise machine is capable of measuring the maximum force which can be opposed by the user. The heavy negative feature allows the force opposing the user to be gradually increased on a return stroke of an exercise repetition from the force applied on the forward stroke of the repetition.

91 Claims, 10 Drawing Sheets

FIG. 2
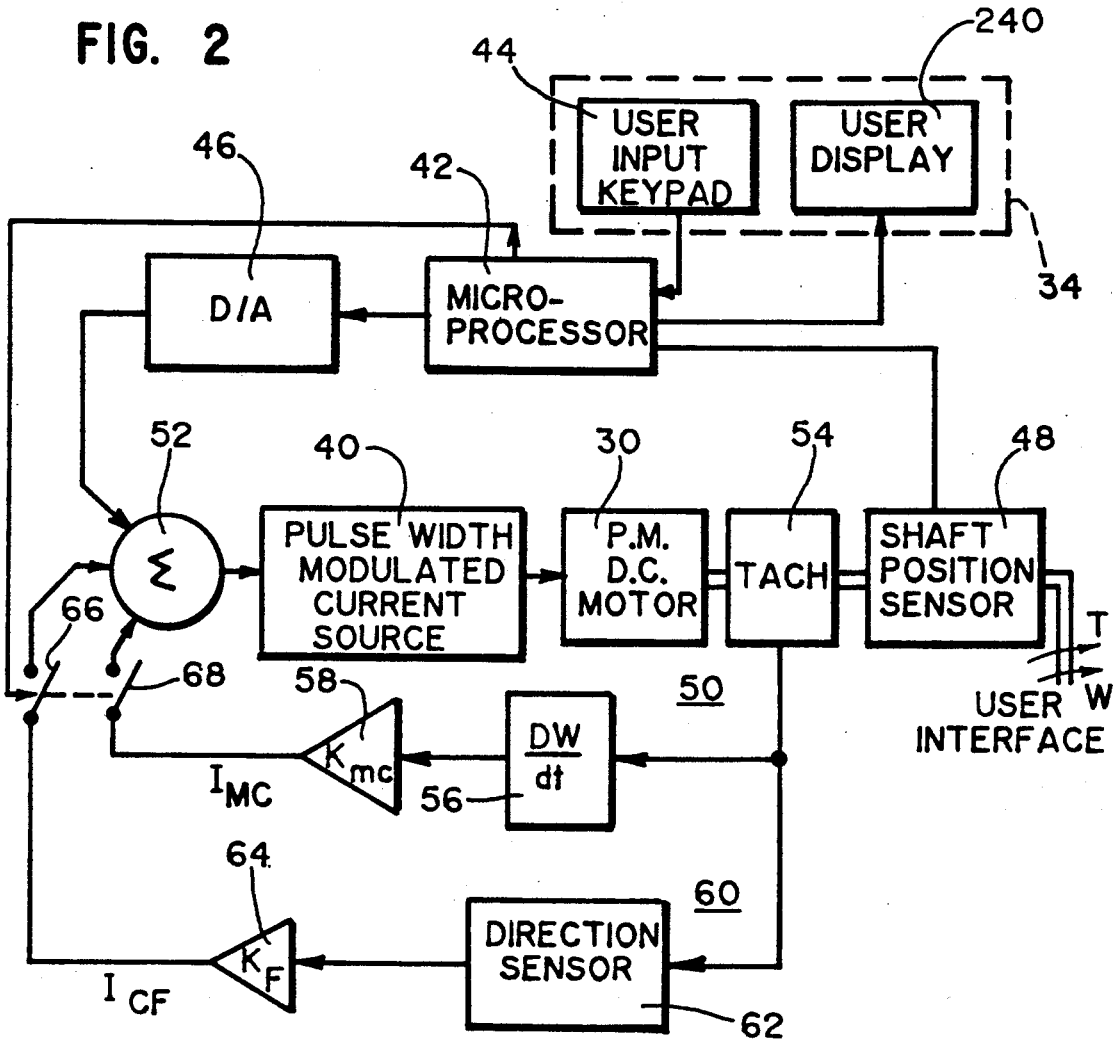
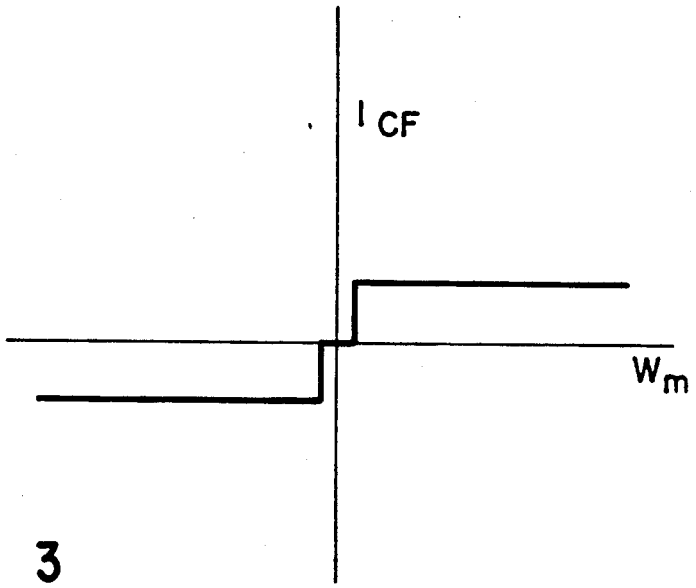
FIG. 3

FIG. 7C
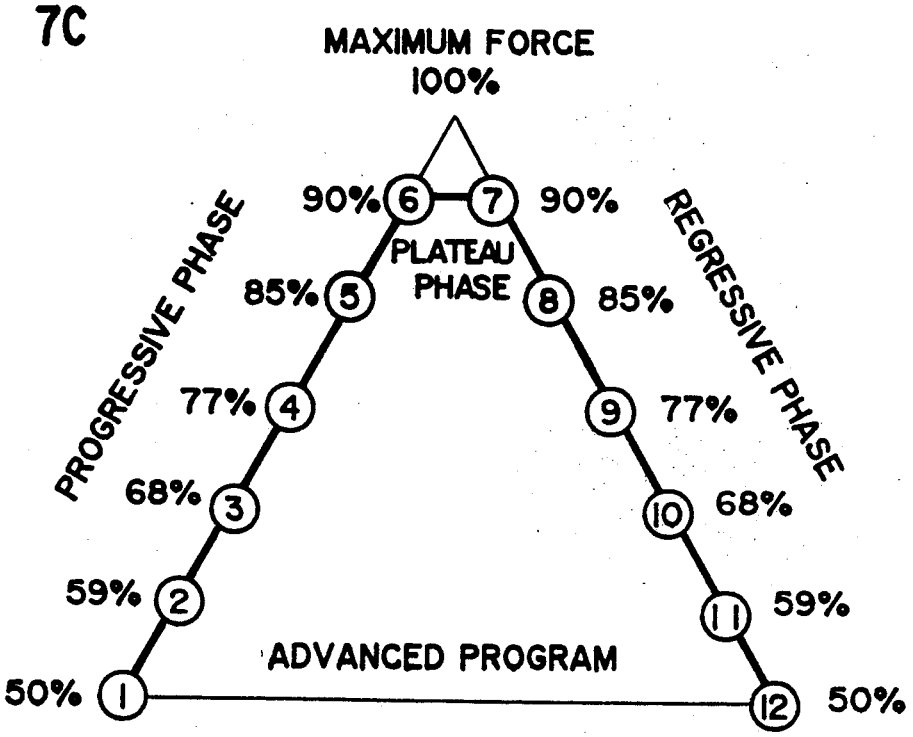
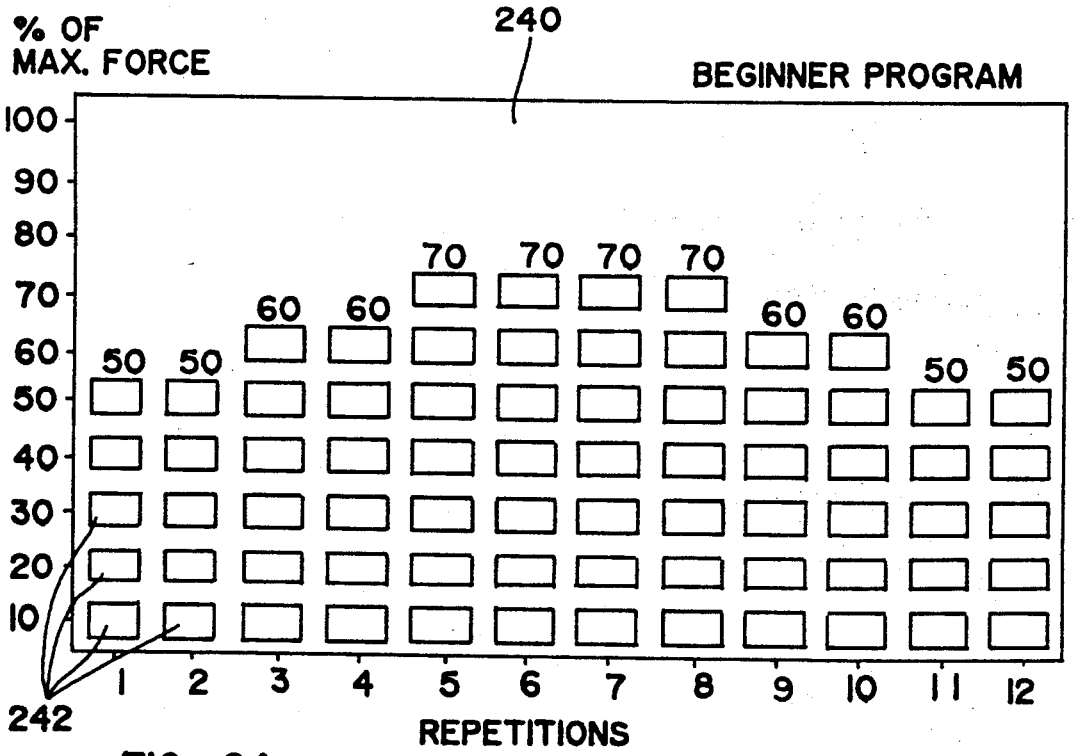
FIG. 8A

FIG. 8B
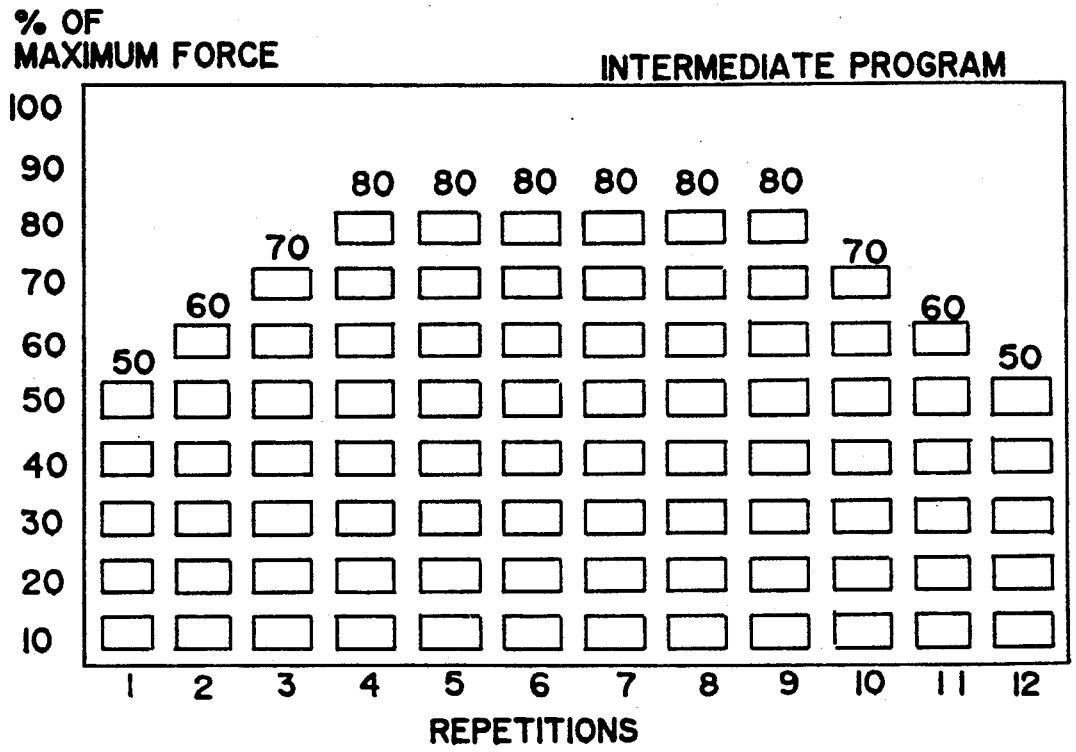
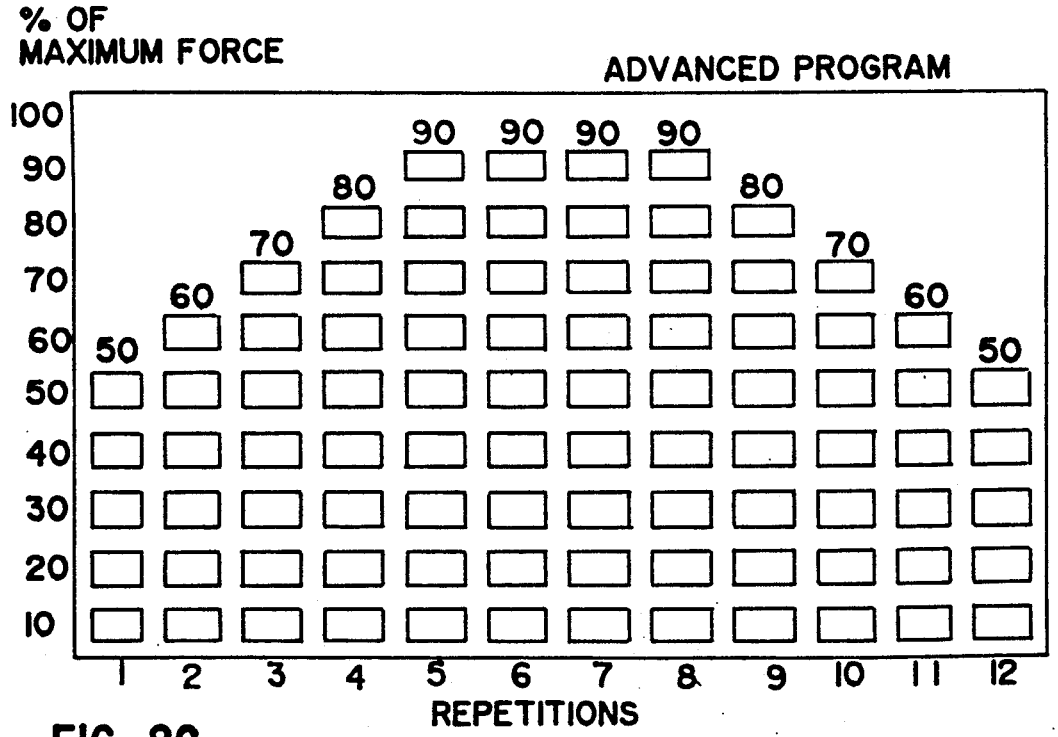
FIG. 8C

MOTOR CONTROL FOR AN EXERCISE MACHINE SIMULATING A WEIGHT STACK

CROSS-REFERENCE TO RELATED APPLICATION

This application is a Continuation-In-Part of the application entitled "Motor Control For An Exercise Machine Simulating a Weight Stack" Ser. No. 004,006, filed on Jan. 16, 1987, now abandoned.

TECHNICAL FIELD

The invention relates to an exercise machine in which an electric motor is used to generate a user opposition force and more particularly to a system for controlling the motor in such a manner as to accurately simulate a weight stack.

BACKGROUND OF THE INVENTION

Traditional weight lifting exercise machines typically couple a stack of iron weights through a series of pullerys and levers to hand grips or other types of user interfaces that are utilized by the user to lift the weight stack. To vary the force opposing the user in such weight lifing machines, the user is typically required to change the position of a mechanical locking pin and physically add or remove weights from the stack. Because it is relatively time consuming and inconvenient to change the exercise force level between lifts in such machines, traditional weight lifting machines have not been used to implement exercise programs in which the force level is varied from lift to lift.

Electronically controlled exercise machines are known in which a hydraulic cylinder is used to provide a resistance opposing the movements of user, the cylinder, for example, being controlled by a computer through a stepper motor. An example of such a machine is disclosed in U.S. Pat. No. 4,544,154. Although this type of exercise machine is more flexible than traditional weight lifting machines, they tend to be very costly to manufacture and maintain. They are also limited in that they only provide a resistance to the user's motions and as such cannot be used to accurately simulate a weight machine nor to implement a heavy negative type program.

Also, attempts have been made to create exercise machines employing motors to provide a force to oppose the user. An example of one such machine is disclosed in UK Patent Application GB No. 2 157 578A. However, these machines generally have problems with stability and do not adequately simulate the feel of a weight stack to the user. A description of an apparatus that overcomes certain of the stability problems is provided in the co-pending U.S. patent application entitled "Motor Control Circuit For A Simulated Weight Stack," Ser. No. 107,970, filed Oct. 13, 1987 and assigned to the assignee of this application.

Electric motors have been used in exercise and rehabilitation machines such as the apparatus disclosed in U.S. Pat. No. 4,691,694. In this apparatus a closed loop servo system using a user force signal and a speed signal drives a fixture. The limits of motion of the fixture can be manually set by the user. However, these machines are not designed to simulate a weight stack.

An example of the implementation of a heavy negative force is provided in U.S. Pat. No. 4,563,003 where a motor driven rod is used in a conventional weight stack machine to increase the user opposition force during a downward stroke.

SUMMARY OF THE INVENTION

It is therefore an object of the invention to provide an exercise machine including an electric motor which provides a user opposing force the motor having a servo control to accurately simulate a weight stack and further having a computer control to provide flexibility and to implement unique exercise programs.

It is a further object of the invention to provide an exercise machine for which the inertia and the friction of the motor and the mechanical componets of the machine are compensated in order to more accurately simulate a weight stack. The servo control includes a tachometer for sensing the speed of a rotating shaft driven by the motor, the shaft being coupled to the user interface of the exercise machine to provide the force opposing the user. To compensate for the system's inertia, the output signal of the tachometer representing the speed of the motor shaft is differentiated and scaled by a constant to provide an inertia compensation signal. To compensate for the system's friction, the output signal of the tachometer is used to sense the direction of rotation of the motor shaft to provide a positive direction signal in response to sensed rotation of the shaft in a first direction and a negative direction signal in response to sensed rotation of the shaft in a second direction. The direction signal is then scaled by a constant to provide a friction compensation signal. The inertia compensation signal and the friction compensation signal are combined with a force signal generated by the computer control to provide a counterforce of a predetermined level which accurately simulates the operation of a weight stack.

Another object of the invention is to provide computer control of the motor to vary the inertia compensation as a function of the amount of simulated weight selected by the user and also to compensate for the effects of gravity on the mechanical components of the exercise machine.

It is an additional object of the invention to provide a computer control of the motor for the implementation of a unique exercise program, hereinafter referred to as the pyramid program, designed to achieve maximum efficiency of a workout. The pyramid exercise program has a progressive phase in which the force opposing the user is gradually increased by the computer control from a starting level to a plateau level over a first group of repetitions followed by a plateau phase in which the force opposing the user is maintained constant at the plateau level over a second group of repetitions followed by a regressive phase in which the force opposing the user is gradually decreased by the computer control from the plateau level to the starting level over a third group of repetitions. In one version of the pyramid exercise program, the computer control varies the magnitude of the plateau level force and the number of different progressive level and regressive level repetitions in an exercise in response to the difficulty level selected by a user such that as the level of difficulty increases the magnitude of the plateau level force and the number of different forces applied during the progressive and regressive levels increase. In another embodiment, the computer control also varies the number of plateau level repetitions in an exercise in response to the difficulty level selected such that as the difficulty level increases, the number of plateau level repetitions decreases.

A further object of the invention is to provide a keyboard to allow a user to select the force to be provided by the motor and the difficulty level of the pyramid exercise program. The machine also includes a means for automatically measuring the maximum force which can be opposed by the user. In the pyramid program, the starting level is set at either 50% of the user selected force or the machine measured force. The force applied by the motor is increased during the progressive phase from the starting level to a plateau level of approximately 70% of the selected or machine measured force for a low difficulty level exercise. The force applied by the motor is increased during the progressive phase from the starting level to a plateau level of approximately 80% of the selected or machine measured force for an intermediate difficulty level exercise and is increased to a plateau level of approximately 90% of the selected or machine measured force for a high difficulty level exercise.

Another object of the invention is the provision of a heavy negative feature in which the amount of force applied during the return stroke of a repetition is gradually increased to a maximum value over a given displacement of the user interface from the force applied during the forward stroke of the repetition. The maximum heavy negative force can be selected by the user with the keyboard or can alternatively be automatically set at 1.5 times the maximum force which can be opposed by the user as measured by the exercise machine.

BRIEF DESCRIPTION OF THE DRAWINGS

FIG. 2 is a block diagram of the D.C. motor control of the present invention;

FIG. 3 is a graph illustrating the friction compensation signal as a function of the motor's velocity;

FIGS. 7A-C are graphs illustrating, for one embodiment of a pyramid exercise program, the force levels applied over a series of repetitions for the beginner level, intermediate level and advanced level pyramid programs respectively;

FIGS. 8A-C illustrate, for a second embodiment of the pyramid exercise program, the graphical presentation provided on a display of the exercise machine for beginner level, intermediate level and advanced level pyramid programs respectively;

DETAILED DESCRIPTION OF THE INVENTION

Figure 1:
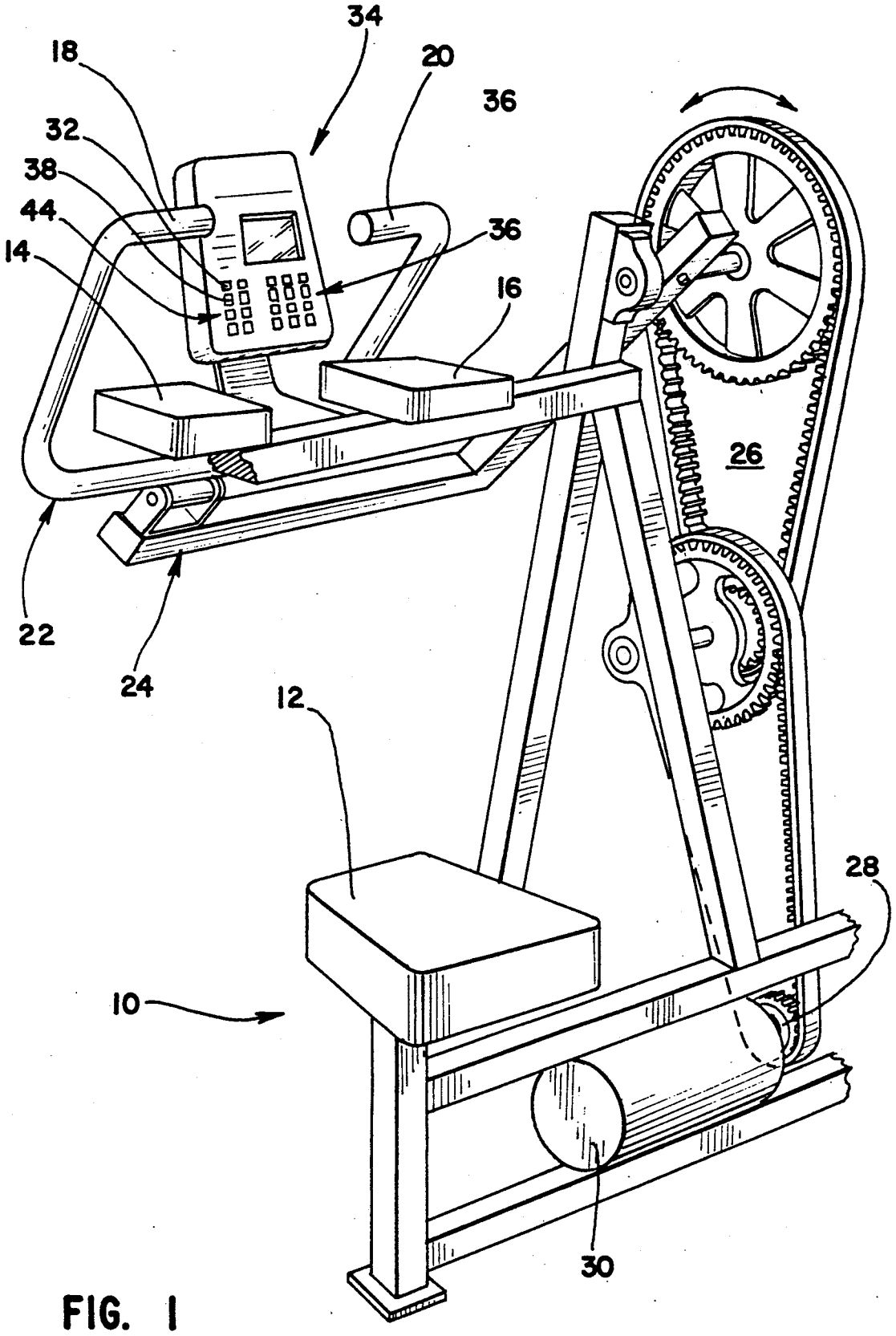
FIG. 1 is a perspective view of the exercise machine employing the D.C. motor control of the present invention.

An arm curl type weight lifting exercise machine indicated generally at 10 employing the motor control of the invention is illustrated in FIG. 1. The exercise machine 10 includes a seat 12, rest pads 14 and 16 for the user's upper arms, and handlebars 18 and 20 forming a user interface 22. The user interface 22 is coupled by a linkage mechanism including a lever assembly generally designated 24 to a pulley assembly generally designated 26 which is in turn coupled to a shaft 28 of a D.C. motor 30. The D.C. motor 30 rotates the shaft 28 in a direction to provide a force opposing the user during both the forward and return strokes of an exercise repetition.

The exercise machine 10 also includes a keyboard and display unit 34 which allows a user to apply control inputs to select the magnitude of the opposition force provided by the motor as well as various exercise programs and options. For example, an input button 32 on the keypad portion 44 of the unit 34 may be used to select a standard program in which the force applied to oppose the user is the force selected by the user using alphanumeric push buttons 36 of the keypad 44. Another push button 38 on the keypad portion 44 of the unit 34 may be used to select a pyramid exercise program in which a progressive force is applied which increases from 50% of the selected force to a plateau level force over a first group of repetitions, followed by application of a constant plateau level force over a second group of repetitions and ending with the application of a regressive force when decreases from the plateau level force to the starting level force of 50% of the selected force over a third group of repetions. A user can also use the keyboard/display unit 34 to select a heavy negative option in which the force applied during the return stroke of a repetition is gradually increased from the force applied during a forward stroke of a repetition over a given displacement of the user interface. The user can also select a maximum force test option using the keyboard/display unit 34 wherein the machine 10 automatically measures the maximum force which can be lifted by a user. These programs and exercise options are discussed in more detail below.

In order to perform an exercise, a user sits on the seat 12 with his upper arms resting on the pads 14 and 16 and grasps the handlebars 18 and 20. On the forward stroke of an exercise repetition, the user pulls the user interface upward towards its maximum displacement such that the angle of flexion at the user's elbow joint goes from 0° when the interface is at a rest position to approximately 130° at maximum displacement. During the forward stroke of a standard repetition, the D.C. motor 30 generates a torque which is transmitted through the shaft 28, pulley assembly 26 and lever assembly 24 so as to apply a force to oppose the user, the magnitude of the force being equal to the magnitude of the force selected by the user or measured by the machine 10. On the return stroke, the user lowers the user interface 22 while the D.C. motor 30 applies either the same force as applied during the forward stroke or a heavy negative force if that option is selected by the user. The heavy negative force may be entered into the system using the keyboard/display unit 34 or a default value can be used such as to 1.5 of the force measured by the machine as the maximum force which can be opposed by the user.

As illustrated in the block diagram of the motor control shown in FIG. 2, the preferred embodiment of the motor 30 is a permanent magnet D.C. motor where the current through the armature of the motor is determined by the output of a current source 40 to provide a torque, and thus a force opposing the user, which is proportional to the motor armature current. The current source 40 is preferably a pulse width modulated current source to moderate of power dissipation.

A digital microprocessor or computer 42 which includes a random access digital memory is responsive to the user input key pad 44 of the unit 34 to provide to an analog to digital (D/A) converter 46 a digital signal representing the force to be applied by the motor 30. The D/A converter 46 converts the digital force signal from the microprocessor 42 to an analog force signal or voltage which is applied to the current source 40 to regulate the armature current of the motor 30 and thus the torque produced by the motor. The microprocessor 42 is responsive to the output of a shaft position sensor 48, which output represents the displacement of the user interface 22, to automatically vary the force applied by the motor 30 during an exercise as discussed below. The shaft position sensor 48 includes a pair of optical sensors coupled to the shaft 28 to produce a pair of pulse trains the number of pulses of which represent the position of the shaft and the phase difference of which represent the direction of travel of the user interface 22. Specifically, a pulse count of 130 pulses represents in the embodiment of FIG. 1 the maximum displacement of the user interface 22.

In one embodiment of the invention the D.C. motor control includes a servo control circuit, generally designated 50, to compensate for the inertia of the mechanical linkage 26 and motor 30 in order to control the motor 30 so as to more accurately simulate an actual weight stack. For lighter weights, if the inertia of the motor 30 and the mechanical linkage 26 is not compensated, the system will not respond as quickly as a real weight stack and will appear to be sluggish to the user. In order to permit the motor 30 to accelerate and decelerate faster, the servo control 50 generates an inertia compensation factor or signal $I_{mc}$ which is subtrated by a summing junction 52 from the force signal provided by the processor 42 to provide an inertia compensated force control signal for the motor 30. The servo control 50 includes a tachometer 54 to measure the speed of rotation of the shaft 28. The output of the tachometer 54, representing the angular velocity of the shaft 28, is differentiated by a differentiator 56 the output of which is scaled by a constant $k_{mc}$ at block 58 to provide the inertia compensation signal $I_{mc}$ which is equal to $$k_{mc}\frac{d\omega}{dt}.$$

The value of $k_{mc}$ is related to the mechanical dynamics of the motor 30 and linkage 26 and is preferably selected experimentally to give the proper user feel to the system 10.

The motor control of FIG. 2 also includes a servo control 60 to compensate for the mechanical friction of the motor 30 and the linkage mechanism 26. On the forward stroke of a repetition, the force due to the friction of the motor 30 and the linkage 26 adds to the controlled force output from the motor; however, on the return stroke of the repetition, the force due to the motor 30 and linkage 26 friction substracts from the controlled force output from the motor. If the motor 30 and linkage 26 friction is not compensated, the force opposing the user on the forward stroke of a repetition will be greater than the force opposing the user on the return stroke of the repetition by a factor of $2F_f$ where $F_f$ is the force due to the friction of the motor 30 and linkage 26. In order to accurately simulate a real weight stack by eliminating the effects of friction on the forward and return strokes of a repetition, the servo control 60 generates a friction compensation factor or signal $I_{cf}$ which is substracted by the summing junction 52 from the force signal provided by the microprocessor 42 to provide a friction compensated control signal coupled to the motor 30. The servo control 60 includes a direction sensor 62 which is responsive to the output of the tachometer 54 for sensing the direction of movement of the user interface 22. The output of the direction sensor 62 is: zero at motor velocities near zero; is a constant positive value for positive motor angular velocity signals, $+\omega$; and is a negative value for negative motor angular velocities, $-\omega$. The output of the direction sensor 62 is scaled by a constant $k_f$ by a block 64 to provide the friction compensation signal $I_{cf}$ as illustrated in FIG. 3.

In order to ensure the stability of the motor control, near zero displacements of the user interface as sensed by the microprocessor 42 in response to the signals from the shaft position sensor 48, the microprocessor 42 provides a disable signal to the servo controls 50 and 60 which in effect opens a pair of switches 66 and 68 to eliminate the servo controls from the system. The switches 66 and 68 when open thus prevent $I_{mc}$ and $I_{cf}$ from being combined with the force signal from the microprocessor 42 near zero displacement or a rest position of the user interface. The problem of instability if the servo control is left in the system near zero displacement of the user interface is a problem largely caused by the servo control 50. Because the servo control 50 produces a term which is proportional to the derivative of the motor velocity, if the user interface 22 strikes the rest position while moving at a high velocity for instance if the user should let go of the handles 18 and 20 with a motor force applied, the derivative of the motor's 30 velocity can approach infinity. This causes the control system to exhibit an undersirable damped oscillation. To prevent this, the microprocessor 42 eliminates the servo control from the motor control as the user interface 22 approaches its rest position at zero displacement. Also as described in the above identified co-pending patent application entitled "Motor Control Circuit For A Simulated Weight Study" Ser. No. 107,970 filed Oct. 13, 1987, stability of the system 10 can be improved by applying power gradually to soft start the motor 30.

Figure 4:
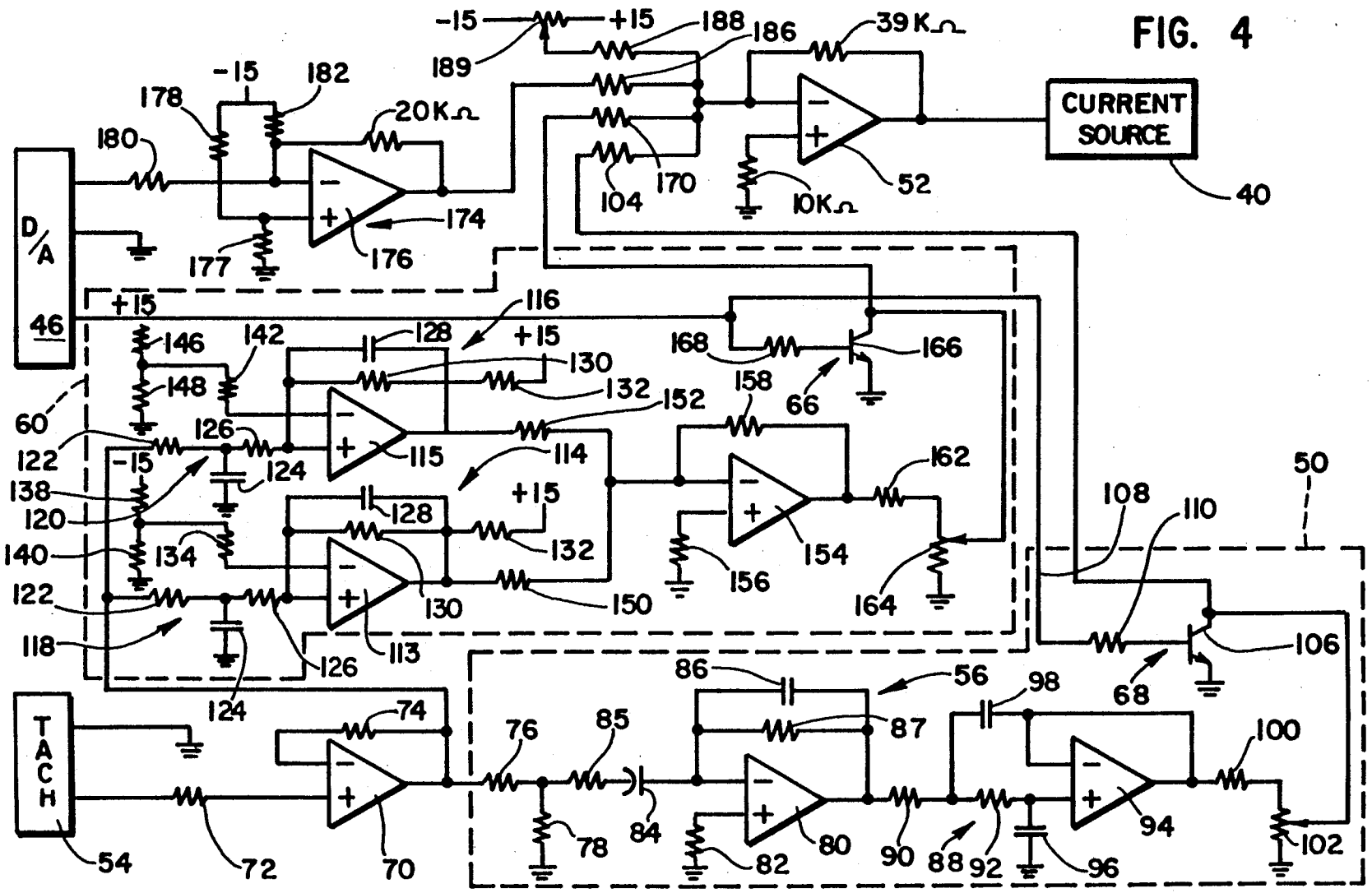
FIG. 4 is a schematic diagram of the D.C. motor control of FIG. 2.

Specific circuitry for the D.C. motor control of one embodiment of the invention will now be described with reference to the schematic diagram of FIG. 4. The output of the tachometer 54 which is a voltage proportional to the rotational velocity of the motor shaft 28 is coupled to the non-inverting input terminal of an op amp 70 through a 10kΩ resistor 72, the output of the op amp being coupled to the inverting input terminal thereof through a 10kΩ feedback resistor 74 to form a buffer. The buffered tachometer voltage is applied to a voltage divider comprised of a 2.2kΩ resistor 76 and a 2.2kΩ resistor 78. The output of the voltage divider is applied to the differentiator 56 of the servo control 50. The differentiator 56 includes an op amp 80 whose noninverting input terminal is coupled to ground through a 100kΩ resistor 82 and whose inverting input terminal is coupled to the output of the voltage divider through a 1 82 f capacitor 84 connected in series with a 20kΩ resistor 85. The differentiator 56 also includes a 0.0027 f capacitor 86 connected in parallel with a 1MΩ resistor 87 between the output of the op amp 80 and the op amp's inverting input terminal. The output of the differentiator 56 is coupled to a low pass filter 88 to prevent high frequency osciallations which may occur due to noise. The low pass filter includes two series connected 47kΩ resistors 90 and 92 connected to the noninverting input terminal of an op amp 94 which is also connected to ground through a 0.75 f capacitor 96. The inverting input terminal of the op amp 94 is connected between the resistors 90 and 92 through a 1.5 f capacitor 98. The output of the low pass filter 88 is coupled through a 2kΩ resistor 100 to a potentiometer 102 which provides the constant $k_{mc}$ to scale the differentiated velocity signal from the tachometer 54. The output voltage of potentiometer 102 is applied to the summing amplifier 52 through a 1.5kΩ resistor 104 when a transistor 106 forming the switch 68 is not biased on. More particularly, the microprocessor through the digital to analog converter 46 applies a low feedback enable signal on a line 108 coupled to the base of the transistor 106 through a 10kΩ resistor 110 to enable the servo control 50 such that the voltage at the output of the potentiometer 102 and the collector of the transistor 106 is applied to the summing amplifier 52. To disable the servo control, the microprocessor 42 through the D/A converter 46 applies a high signal to the base of the transistor 106 to bias the transistor on.

The output of the tachometer 54 from the buffer formed of the op amp 70 is applied to a pair of comparators 114 and 116 forming a portion of the direction sensor 62 of the servo control 60. Each of the comparators 114 and 116 includes a respective op amp 113 and 115 the noninverting input terminals of which are coupled to the output of the tachometer buffer through respective filters 118 and 120. Each of the filters 118 and 120 includes a 5.1kΩ resistor 122 connected in series with a 4.7kΩ resistor 126 with a 0.1 f capacitor 124 connected between the resistors 122 and 126 and ground. Each of the comparators 114 and 116 also includes a feedback path connected between the output of the respective op amp 113, 115 and its non-inverting input terminal comprised of the parallel combination of a 270 pf capacitor 128 and a 1.3MΩ resistor 130 which is connected in series with a 5.1kΩ pull up resistor 132 to +15 volts. The inverting input terminal of the op amp 113 of the comparator 114 is coupled through a 10kΩ resistor 134 between a 5.1kΩ resistor 138 connected to −15 volts and a 100Ω resistor 140 connected to ground. The inverting input terminal of the op amp 115, however, is coupled through a 10kΩ resistor 142 between a 5.1 kΩ resistor 146 connected to +15 volts and a 100⅛ resistor 148 connected to ground. The outputs of the comparators 114 and 116 are coupled through respective 470 k⅛ resistors 150 and 152 to the inverting input terminal of a summing amplifier 154 whose noninverting input terminal is coupled to ground through a 100 kΩ resistor 156 and whose inverting input terminal is connected in a feedback path to the output of the op amp 154 through a 22 kΩ resistor 158. The output of the summing amplifier at node 160 has the same configuration as the friction compensation signal $I_{cf}$ illustrated in FIG. 3. The output of the mode 160 is coupled through a 2 kΩ resistor 162 to a potentiometer 164 which scales the signal at node 160 by the constant $k_f$ to provide the friction compensation signal $I_{cf}$ at the output of the potentiometer 164 and the collector of a transistor 166. The transistor 166 froms the switch 66 and is such that when the low feedback enable signal is coupled to its base through a 10 kΩ resistor 168, the friction compensation voltage $I_{cf}$ is coupled to the inverting input terminal of the summing amplifier 52 through a 47 kΩ resistor 170.

The digital force signal from the microprocessor 42 is converted to a bipolar voltage by the D/A converter 46. The bipolar output of the D/A converter 46 is applied to a level translator 174 to convert the D/A output signal to a single polarity signal ranging from zero to a negative voltage. The level translator includes an op amp 176 whose non-inverting input terminal is coupled to ground through a 20 kΩ resistor 177 and to −15 volts through a 47 kΩ resistor 178. The inverting input terminal of the op amp 176 is coupled to the output of the digital to analog converter 46 through a 20 kΩ resistor 180 and is coupled to −15 volts through a 47 kΩ resistor 182. The output of the level translator 174 is coupled to the inverting input terminal of the summing amplifier 52 through a 47 kΩ resistor 186. A potentiometer comprised of a 50 kΩ resistor 189 coupled between −15 volts and +15 volts is also coupled to the inverting input terminal of the summing amplifier 52 through a 47 kΩ resistor 188. The output of the summing amplifier 52 is the control signal applied to the current source 40 to control the motor 30 with the motor 30 and linkage 26 inertia and friction thus having been compensated.

In the preferred embodiment of the invention the logic described above in connection with FIG. 4 is performed programmatically by the microprocessor 42 with the output of shaft position sensor 48 differentiated mathematically in softward to provide the rotational velocity signal $\omega$ and further differentiated to provide an acceleration signal $\alpha$ for the inertia compensation.

Figure 5:
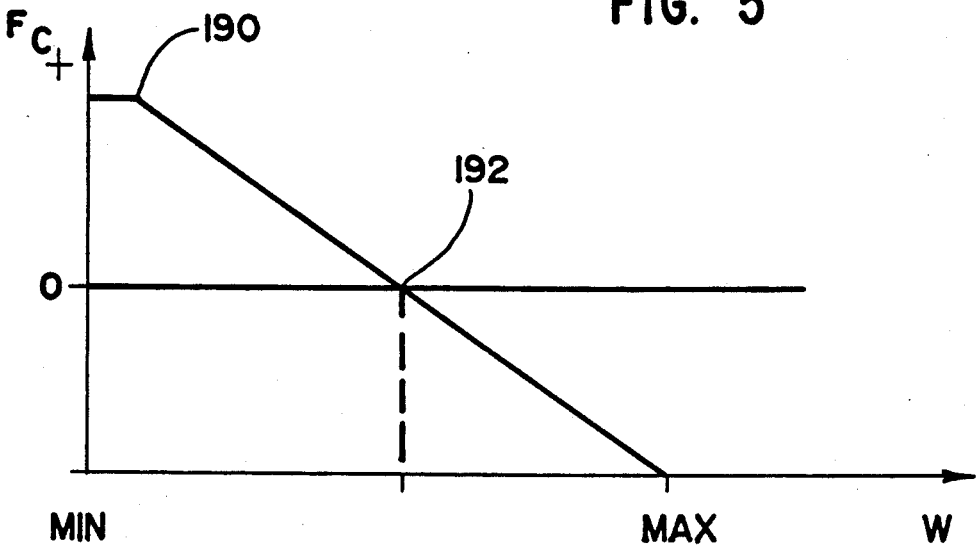
FIG. 5 is a graph illustrating the inertia compensation of the motor as a function of user selected simulated weights.

To provide a more realistic feel for the system 10, the processor 42 in the preferred embodiment of the invention varies as illustrated in the graph of FIG. 5 the inertia compensation as a function of the value of the simulated weight selected by the user. For a minimum selected weight where the inertia of the motor 30 and the linkage 26 would substantially exceed the selected simulated weight, a maximum positive value ofthe compensation factor $F_c$ corresponding to signal $I_{mc}$ is generated by the processor 42 thereby reducing the opposition force as a function of the motor's acceleration $\alpha$ to in effect subtract out the mechanical inertia of the system 10. As the simulated weight is increased, a point indicated at 190 will be reached where the inertia compensating factor will start to be reduced. Then at another point 192 where for example the inertia of the system 10 including motor 30 and linkage 20 would be approximately equal to the inertia of the simulated weight, the compensatory factor $F_c$ would be zero. Past this point 192 the addition of simulated weight would result in a negative application of the compensatory factor $F_c$ resulting in an increase in the torque output of the motor 30 as a function of $\alpha$ to simulate the physical inertia of the simulated weight stack.

As indicated before it is also desirable to compensate the motor 30 output for mechanical friction in the system 10. However in the preferred embodiment of the invention the processor 42 only compensates for about 60% of the motor 30 and linkage 26 friction. Compensation for all of the friction in the system 10 can lead to instability.

To further improve the performance of the system 10, the preferred embodiment of the invention also compensates for the effects of gravity on the user interface 22 and linkage mechanism 26. The gravity compensation factor $F_g$ is an additive function generated by the processor 42 after the inertia and friction compensations have been made and applied to the motor 30. The correction factor $F_g$ is stored in the processors 42 memory and has a value for each position of the user interface 22. Taking as an example the arm curl mechanism of FIG. 1 the values of $F_g$ would generally relate to the following:

$$F_g=((W_b\times\cos A)/F_m)\times K$$

where:

$W_b$=weight of the bars 18 and 20;

A=the angles made by the bars 22 and 24 with the horizontal;

$F_m$=the maximum force output of the motor 30; and

K=a constant relating to the dynamics of the system.

Of course it will be understood that the preferred $F_g$ corrections will depend upon the specific mechanical configuration of the particular system and the above example is provided only as a general guide.

Figure 6:
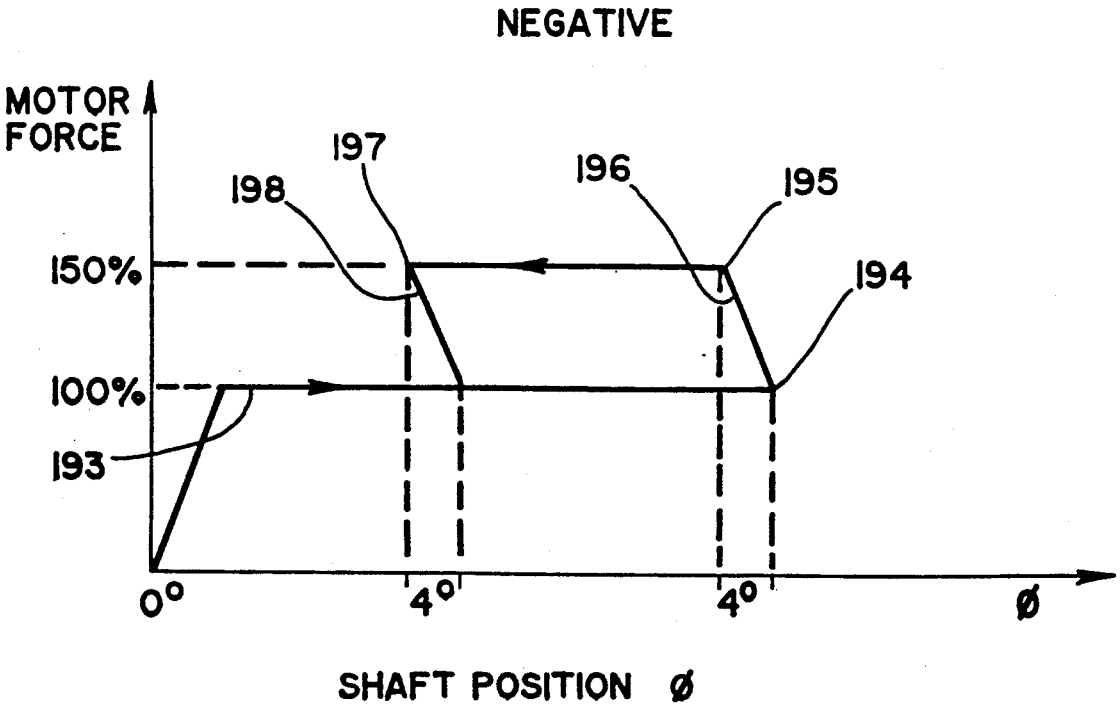
FIG. 6 is a graph illustrating operation of a heavy negative feature.

The preferred embodiment of the heavy negative feature is illustrated in the graph of FIG. 6. In an exercise program utilizing a heavy negative feature, the processor 42 causes the motor 30 to output 100% of the selected opposition force for the forward stroke of the repetition as indicated by line 193 of FIG. 6. At the end of the forward stroke as indicated at 194, the processor 42 detects a change in direction of the motor shaft from the output of the position sensor 48 and begins to increase the opposition force for the return stroke. In this example the opposition force is increased to the maximum value of 150% shown at 195 of the selected opposition force over a shaft rotation of about 40. During the return portion of the stroke illustrated by line 196 the opposition or heavy negative force is maintained at 150% of the remainder of the return stroke. The graph of FIG. 6 also shows how the preferred embodiment operates if the user should stop the return stroke at point 197 before the return stroke is completed. When the processor 42 detects that the return stroke has stopped 197 and that a forward stroke has resumed the heavy negative portions of the opposition force is reduced over a shaft displacement of 40 to the original forward force level as indicated by a line 198. In this embodiment, the application of the heavy negative force is dependent on the direction of the user's stroke even if he should change direction in the middle of a repetition. Also, the heavy negative portion of the force is applied or removed gradually over a specified number of degrees of shaft rotation, thus adding to the smoothness of operation of the system 10.

A user of the exercise machine 10 can select a pyramid exercise program using the key pad 44 of the keyboard/display unit 34. The microprocessor 42 is responsive to the selection of a pyramid exercise program by controlling the D.C. motor 30 to apply a force to oppose the user which is gradually increased from a starting level to a plateau level over a first group of repetitions forming the progressive phase of the exercise. The progressive phase of the pyramid exercise is followed by a plateau phase in which the force opposing the user is maintained constant at the plateau level over a second group of repetitions. The plateau phase is followed by a regressive phase in which the force opposing the user is gradually decreased under the control of the microprocessor 42 from the plateau level to the starting level over a third group of repetitions.

Figure 7A:
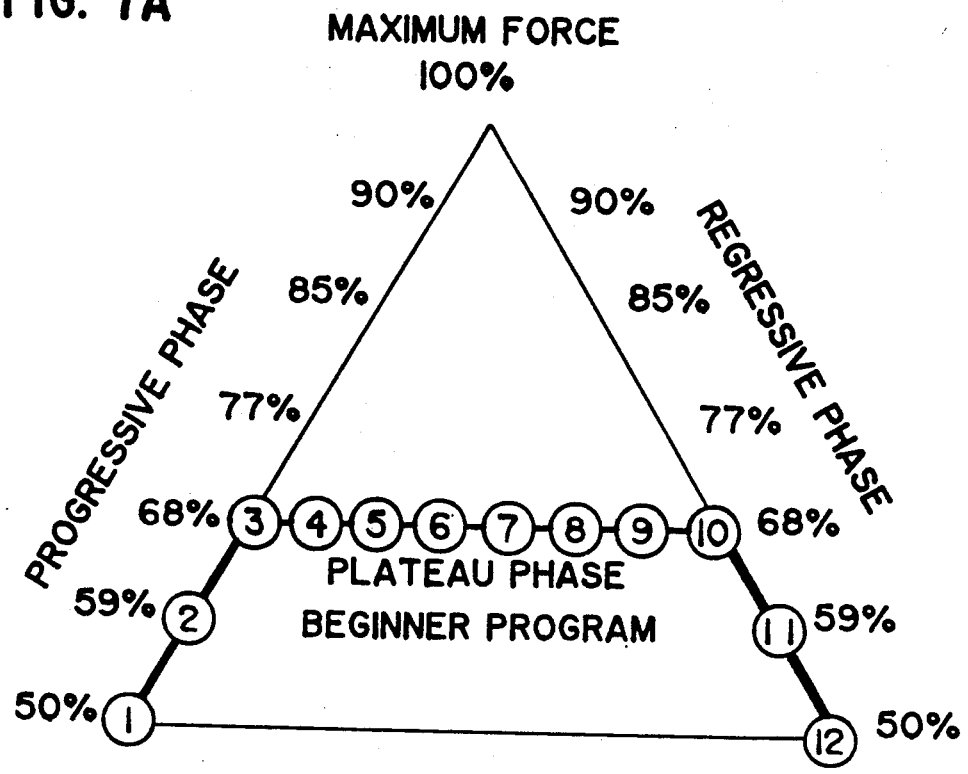
Figure 7B:
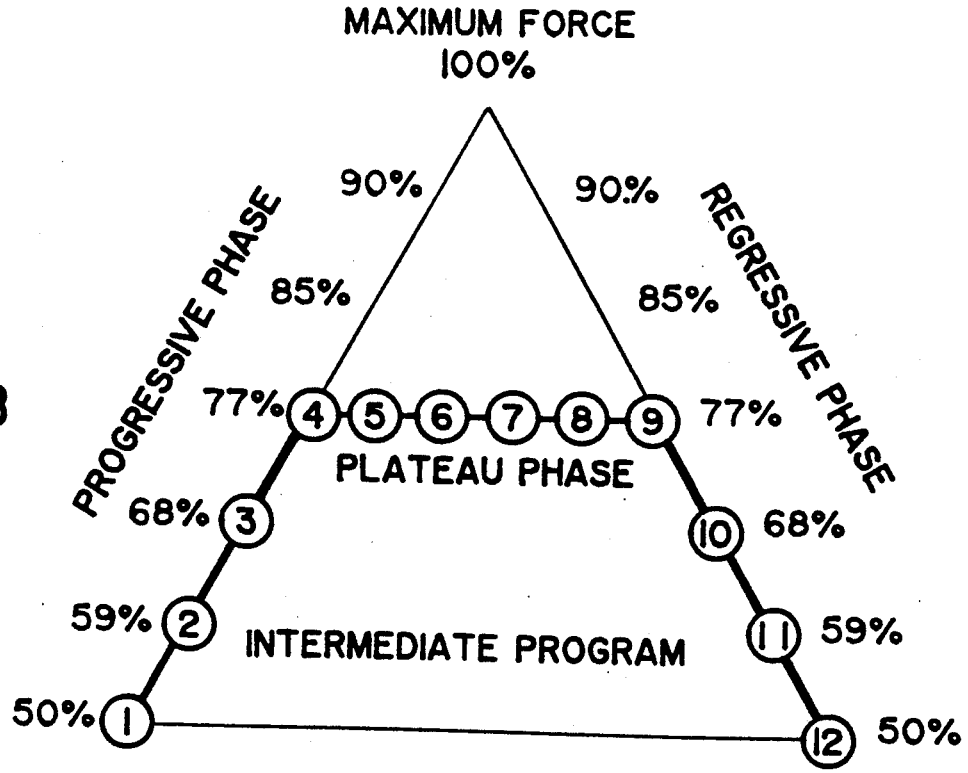

FIGS. 7A-7C illustrate one embodiment of the pyramid exercise program implemented by the D.C. motor 30 under the control of the microprocessor 42. If the user selects the beginning level exercise program which provides an exercise having a low level of difficulty, the microprocessor 42 controls the D.C. motor 30 as follows with reference to FIG. 9 to provide the progressive level, plateau level and regressive level forces shown in FIG. 7A. When the microprocessor 42 determines at block 200 that the beginner pyramid exercise program has been selected in response to a signal from the user input key pad 44, the processor 42 at block 202 sets a variable, max force, equal to the user selected force or the force measured by the machine as the maximum force capable of being opposed by the user. At block 204, the microprocessor 42 initializes a counter to X=1 and at block 206 provides a force signal to which the current source 40 responds by controlling the motor 30 to apply a force which is equal to 50% of max force set at block 202. The exercise machine may include a mechanical switch or the like which senses when the user interface 22 is at a rest position. The microprocessor 42 may be responsive to such a switch to determine at block 208 whether the repetition number X has been completed. If the repetition has not been completed, the microprocessor 42 does not increase the force applied by the motor but continues to control the motor 30 to apply a force equal to 50% of max force at block 206. When the processor 42 determines that repetition number X has been completed at block 208, the X counter is incremented at block 210 to X=X+1. Thereafter, the microprocessor 42 at block 212 controls the motor 30 to apply a force equal to 59% of max force. Upon sensing the completion of repetition number X at block 214, the processor 42 increments the X counter to X=X+1 at block 216 and at block 218 controls the motor 30 to apply a plateau level force of 68% of max force. When the microprocessor 42 determines that repetition number X has been completed at block 220, the processor increments the X counter at block 22 to X=X+1. At block 224, the microprocessor 42 determines whether X is equal to 11 in order to start the regressive phase shown in FIG. 7. If X is not equal to 11, the microprocessor 42 returns to block 218 to apply the plateau level force of 68% of max force on the next repetition. When the microprocessor 42 determines that X is equal to 11, at block 226 the processor controls the motor 30 to apply a force equal to 59% of max force to start the regressive phase of the pyramid exercise. Upon determining that the repetition number X has been completed at block 228, the microprocessor 42 at block 230 increments the X counter to X=X+1 and at block 232 controls the motor 30 to apply the starting force of 50% of max force. Upon determining, at block 234, that the repetition number X, i.e. the twelfth repetition has been completed the microprocessor 42 exits the routine at block 236.

Figure 9:
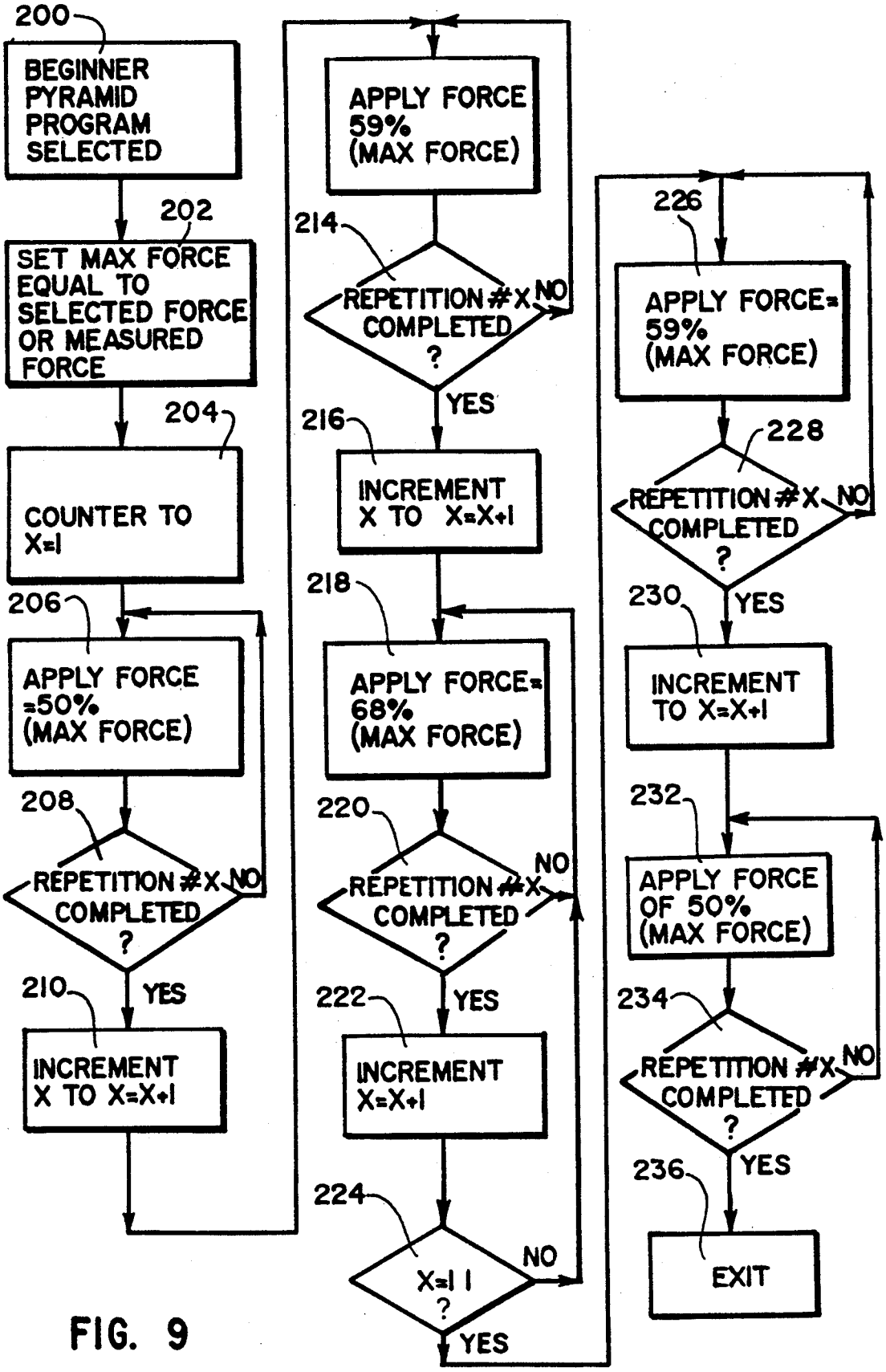
FIG. 9 is a flowchart illustrating the software for implementing a beginner level program having the force levels depicted in FIG. 5A.

The software to control the intermediate level pyramid program shown in FIG. 7B and the advanced level pyramid program shown in FIG. 7C is essentially the same as that depicted in FIG. 9 for the beginner level pyramid program with minor variations thereto to provide the various forces specified for each of these programs and therefore is not described herein. As shown in FIG. 7B, for the intermediate program, the microprocessor 42 controls the motor 30 to provide on the first repetition a starting level force of 50% of max force which is equal to either the user selected force or machine measured force. On the second repetition, the microprocessor 42 controls the motor 30 to apply a force equal to 59% of max force and on the third repetition of force equal to 68% of max force. The progressive phase of the intermediate level pyramid exercise program ends with the microprocessor 42 controlling motor 30 to apply a plateau level force of 77% of max force on the fourth repetition. This plateau level force is applied by the motor 30 under the control of the microprocessor 42 over the repetitions 4 through 9. On the tenth repetition, the microprocessor 42 controls the motor 30 to decrease the force applied from the plateau level force to a force equal to 68% of max force to begin the regressive phase. For the eleventh repetition, the microprocessor 42 controls the motor 30 to apply a force equal to 59% of max force and on the twelfth repetition the processor controls the motor 30 to apply a force equal to the starting level force which is 50% of max force.

As shown in FIG. 7C for an advanced level pyramid exercise, the microprocessor 42 controls the motor 30 to provide a starting level force of 50% of max force on the first repetition, a force of 59% of max force on the second repetition, a force of 68% of max force on the third repetition, a force of 77% of max force on the fourth repetition, a force of 85% of max force on the fifth repetition and a plateau level force of 90% on the sixth repetition during the progressive phase. For the advance program of FIG. 7C, the plateau phase consists of the sixth and seventh repetitions during which the microprocessor 42 controls the motor to apply the plateau level force which is 90% of the max force. During the regressive phase of the advanced program, the microprocessor 42 controls the motor 30 to apply a force equal to 85% of max force on the eighth repetition, a force equal to 77% of max force on the ninth repetition, a force equal to 68% of max force on the tenth repetition, a force of 59% of max force on the eleventh repetition and a force of 50% of max force on the twelfth repetition.

As seen from FIGS. 7A–7C, the microprocessor 42 controls the motor 30 such that as the level of difficulty increases from the beginner to the advanced levels, the magnitude of the plateau level force and the number of forces applied during the progressive and regressive levels increase while the number of plateau level repetitions in the exercise decreases. FIGS. 8A–8C illustrate a second embodiment of the pyramid exercise program in which, as the level of difficulty increases from the beginner level to the advanced level, the magnitude of the plateau level force and the number of different forces apply during the progressive and regressive levels increase whereas the number of plateau level repetitions does not decrease.

FIGS. 8A–8C illustrate the graphical presentation provided on the display 240 of the keyboard/display unit 34 during the beginner, intermediate, and advanced level pyramid exercise programs of the second embodiment.

More particularly, during each pyramid exercise program the display 240 depicts the percentage of max force to be lifted by the user for each of the twelve repetitions forming the exercise. As the user lifts the user interface 22, the blocks 242 shown on the display are lit and stay lit when the user moves the interface 22 to its maximum displacement position. If the user does not reach the maximum displacement of the interface 22 with the specified percentage of max force being applied, the display does not maintain the blocks of that repetition column on the display lit indicating to the user that he must repeat the repetition to proceed to the subsequent repetition.

The beginner pyramid exercise program of the second embodiment as shown in FIG. 8A is such that the microprocessor 42 controls the motor 30 to apply a starting level force of 50% over the first and second repetitions, a progressive level force of 60% over the third and fourth repetitions, a plateau level force of 70% of max force over the fifth through eighth repetitions, a regressive force of 60% of max force over the ninth and tenth regressive phase repetitions and the starting level force of 50% of max force over the eleventh and twelfth repetitions.

As shown in FIG. 8B for the intermediate pyramid program of the second embodiment, the microprocessor 42 controls the motor 30 to apply a force equal to 50% of max force on the first repetition, a force equal to 60% of max force on the second repetition, a force of 70% of max force on the third repetition and a plateau level force of 80% of max force on the fourth repetition. The microprocessor 42 continues to control the motor 30 to apply the plateau level force of 80% of max force over the fifth through ninth repetitions during the plateau phase followed by a regressive phase wherein the force applied by the motor on the tenth repetition is equal to 70% of max force, on the eleventh repetition the force applied is equal to 60% of max force and on the twelfth repetition, the force applied by the motor 30 is equal to 50% of max force.

As shown in FIG. 8C for the advanced level pyramid program of the second embodiment, the microprocessor 42 controls the motor to provide a starting level force of 50% of max force on the first repetitions, 60% of max force on the second repetition, 70% of max force on the third repetition, 80% of max force on the fourth repetition, a plateau level force of 90% of max force on the fifth through eighth repetitions, a regressive phase force of 80% of max force on the ninth repetition, a force of 70% of max force on the tenth repetitions, of force of 60% of max force on the eleventh repetition and a force of 50% of max force on the twelfth repetition. The software required by the microprocessor 42 to implement the pyramid exercise programs depicted in FIGS. 8A–8C is essentially the same as that depicted in FIG. 9 with minor variations thereto to provide the particular forces shown and therefore is not described herein.

Figure 10:
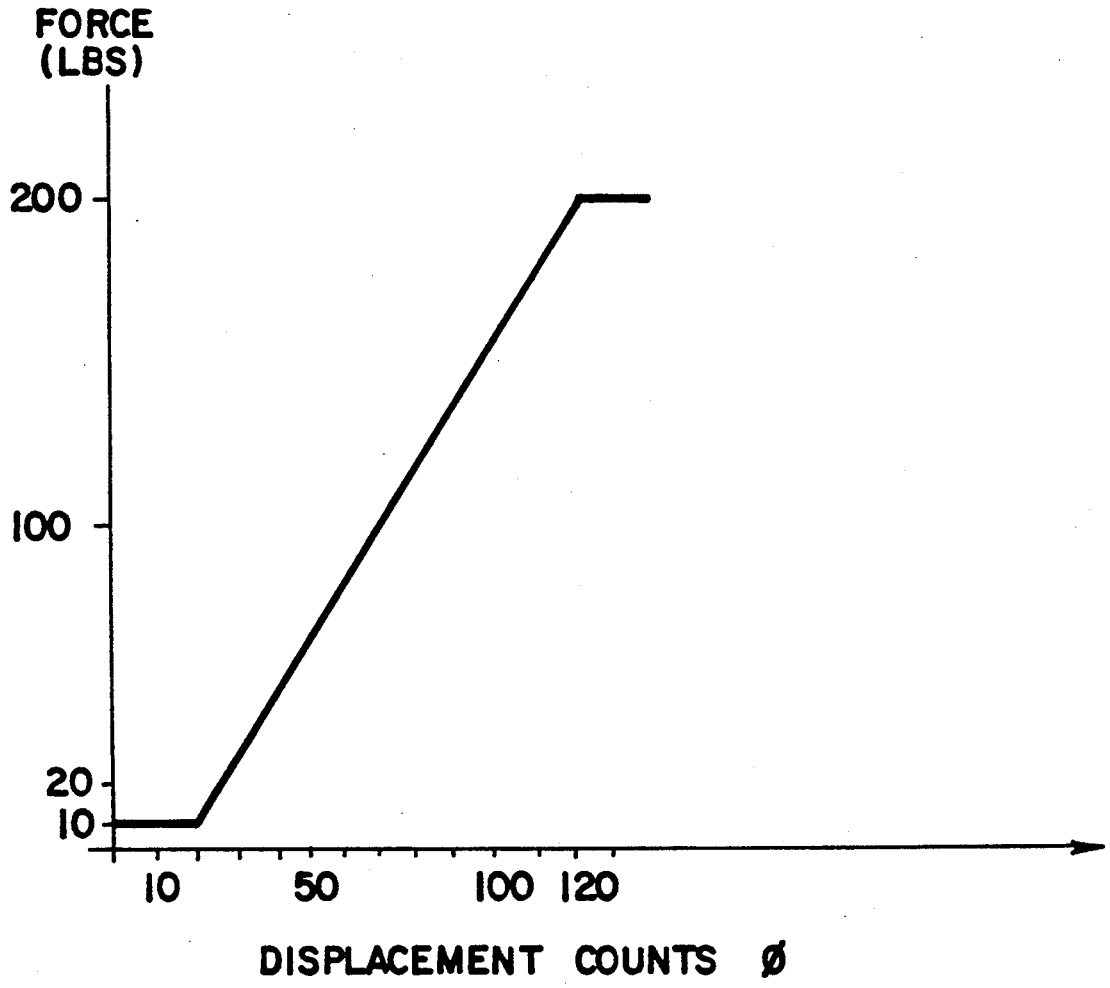
FIG. 10 is a graph illustrating the force applied by the exercise machine as a function of the displacement of the user interface when the machine is measuring the maximum force which can be opposed by a user.

FIG. 10 illustrates in graphical form the mechanism by which the system 10 can be used to determine the maximum force that can be generated by a user. In order for the exercise machine 10 to measure the maximum force which can be opposed by a user, the user selects the maximum force test option using the key pad 44 of the unit 34. The microprocessor 42 is responsive to the selection of the maximum force test option to instruct the user to lift the user interface 22 while controlling the D.C. motor 30 to apply a force, as depicted in FIG. 10, which varies as a function of the displacement $\phi$ of the interface 22 and thus, as a function of the displacement or count output from the sensor 48 wherein a displacement count of approximately 130 counts represents the maximum displacement of the user interface 22. The microprocessor 42 is responsive to the output of the sensor 48 to determine a change in direction of the user interface 34. The processor then stores the force value applied by the motor at the point of the reversal of direction of the interface 22 as equal to the maximum force which can be opposed by the user, i.e., the max force.

If the user selects the heavy negative feature of the present invention using the key pad 44 of the unit 34, the user can enter on the key pad, the value of the heavy negative force he wishes to oppose on the return portion of a stroke or the user may opt to use preset heavy negative force which can be, for example, equal to 1.5 of the maximum force which can be opposed by the user as determined during the maximum force test of FIG. 10. If the heavy negative feature is selected, upon sensing a reversal in direction of the user interface following the forward stroke of each repetition, the microprocessor 42 controls the motor 30 to gradually increase the force applied over a given displacement of the user interface. As previously described in connection with FIG. 6, if the microprocessor 42 increases the force from a forward stroke force of F+ to the heavy negative force of F− over a displacement of four displacement counts or degrees $\phi$ from the sensor 48, the microprocessor 42 increases the force by a factor of $$\frac{F- - F+}{4}$$

on each of the first four pulses from the sensor 48 received by the microprocessor after the reversal of the direction of the interface 22 is sensed. The heavy negative feature can be used with the standard exercise program.

Figure 11:
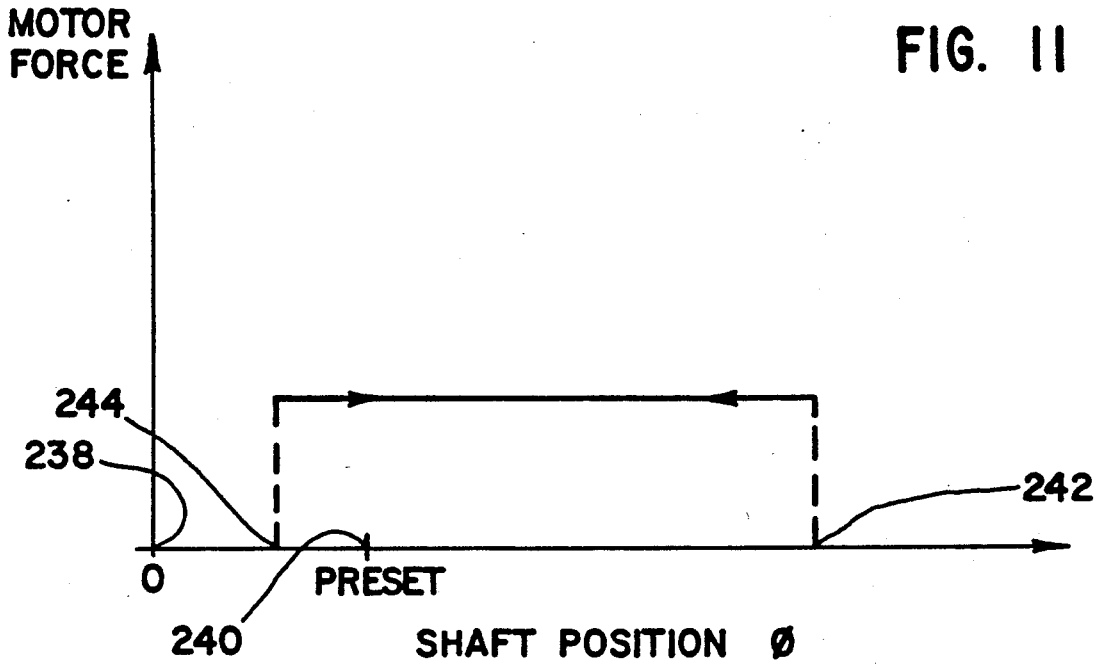
FIG. 11 is a graph illustrating the operation of the exercise machine for a series of repetitions.

Another feature of the preferred embodiment of the invention as illustrated in FIG. 11 is the ability of the processor 42 as shown in FIG. 2 to preposition portions of the user interface 22 such as handles 18 and 20 of FIG. 1 prior to the initiation of an exercise or strength test. Since individual users tend to vary significantly in the length of their various limbs, it has been found that it is not always convenient for certain users, for example individuals with short arms, to reach the handles 18 and 20 when the user interface is in the rest position indicated by 238 in FIG. 11. Therefore, upon initiation by a user of an exercise or strength test program by pressing the appropriate key on the keyboard 34, the processor 42 will automatically move the user interface 22 to a present position 240. The preset position 240 is one at which most users can easily grasp the handles 18 and 20. Preferrably the processor 42 will use the position inputs from the shaft position sensor 48 to cause the motor 30 to move the interface from rest 238 at a constant but relatively low velocity to the preset position 240. Although this feature has been described in terms of the arm curl machine of FIG. 1, it is especially useful in other types of motor driven exercise equipment such as should press or chest press machines.

FIG. 11 also serves to illustrate another feature of the invention which permits the user to define the parameters of the stroke in an exercise program. After initiation of the program as described above, the user will move the user interface 22 forward to a maximum exercise displacement $\phi$ indicated by 242 with which he feels comfortable. Then the end of the first return stroke at 244 is identified by the processor 42 and stored in the processor's memory. This end point is identified by the processor 42 by determining the information from the position sensor 48 when the direction of stroke has stopped and started in the opposite direction. Thus the parameters of the stroke are automatically determined. Thereafter for each repetition of the exercise the processor will apply the opposing force to the user interface 22 between the points 244 and 242 as generally indicated by a line 246. In this manner the user is able to customize the length of his stroke to suit his physical characteristics.

Also, it should be understood that even though line 246 in FIG. 11 is depicted as a straight line implying that the opposition force generated by the motor 30 between points 244 and 242 is constant, the opposition force can be programmed by the processor 42 to vary as a function of shaft position $\phi$. In fact, one of the advantages of using a digital computer for the processor 42 is that a variety of exercise programs can be implemented such as the pyramid program of FIGS. 7–9 or the opposition force versus shaft position $\phi$ can be varied to correspond to various types of cam actions found on conventional weight stack machines.

Figure 12:
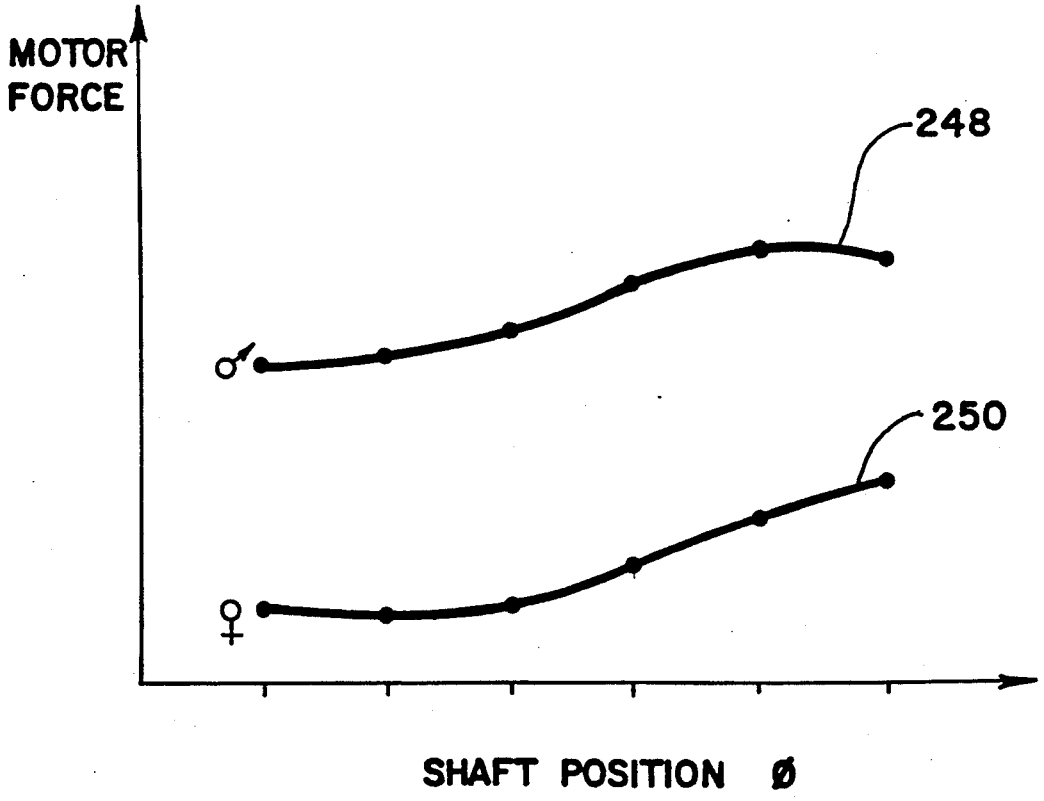
FIG. 12 is a graph illustrating typical strength curves for men and women.

Another feature of the invention is the ability of the machine 10 to provide customized strength curves for individual users as illustrated by the graph of FIG. 12. By measuring an individual's strength for each position of the user interface 22 as represented by the shaft position $\phi$, the resulting strength curve can be used to implement an optimum exercise program for that individual. Also it has been discovered that the relative shape of strength curves for men and women differ significantly. The graph of FIG. 12 depicts a typical strength curve 248 for men and a typical strength curve for women 250 as measured on an arm curl machine 10 of the type shown in FIG. 1.

Strength curves for individuals are measured by the system 10 using an isokentic strength test program. Upon initiation of the isokentic strength test the processor 42 utilizing the shaft position sensors 48 as a source of velocity feedback information causes the user interface 22 to move in the forward stroke direction at a constant velocity. The torque generated by the motor 30 required to overcome the user's opposition force, and to keep the user interface moving at the constant velocity is measured for each shaft position $\phi$ and stored in the processor's 42 memory. This will result in the storage in the computer's 42 memory of a strength curve of the type shown in FIG. 12. since an individual strength can vary over time, the computer's 42 memory is configured to store a number of such curves for each individual with an indication as to when the curve was created. Also the display 34 is configured to graphically display in response to a user input on keyboard 44 a selected strength curve. In this manner a user can determine the progress he is making in his exercise program.

After the isokentic strength test has been performed, the user initiates by pressing the appropriate control on the keypad 44 an exercise routine where the opposition force generated by the motor 30 as a function of shaft position $\phi$ functionally corresponds to the user's strength curve stored in the processor's 42 memory. In most exercise programs the opposition force generated by the motor 30 will have a value less, for example 70% of the value of the force contained in the strength curve. Alternatively, the user has the option to select a typical strength curve for men or women such as 248 or 250 for the exercise program.

We claim:

1. An exercise machine comprising:
a user interface;
an electric motor;
linkage means for mechanically connecting said user interface to said electric motor;
control means operatively connected to said electric motor for generating a power input signal for controlling the torque output of said electric motor;
user input means operatively connected to said control means for permitting a user to operate the exercise machine; and
compensation means operatively connected to said control means for subtracting from said power input signal a compensation factor effective to reduce the torque output of said electric motor to compensate for at least a portion of the inertia of said electric motor.

2. The exercise machine of claim 1 wherein said compensation factor additionally compensates for the inertia of said linkage means.

3. The exercise machine of claim 2 wherein said compensation factor additionally includes a motor friction factor to compensate of at least a portion of the friction of said electric motor.

4. The exercise machine of claim 3 wherein said compensation factor additionally includes a linkage friction factor to compensate for at least a portion of the friction of said linkage means.

5. The exercise machine of claim 4 wherein said compensation factor compensates for less than all of the combined friction of said electric motor and linkage means.

6. The exercise machine of claim 5 wherein said compensation factor compensates for approximately 60% of the combined friction of said electric motor and said linkage means.

7. The exercise machine of claim 5 wherein said control means additionally includes motion means for detecting a forward stroke and a return stroke of said user interface and wherein said motor friction factor is effective to reduce the torque output of said electric motor during said forward stroke.

8. The exercise machine of claim 7 wherein said motor friction factor is effective to increase the torque output of said electric motor during said return stroke.

9. The exercise machine of claim 8 wherein said compensation means eliminates said motor friction factor when said user interface approaches a rest position.

10. The exercise machine of claim 4 wherein said control means additionally includes position means for detecting the positions of said user interface and wherein said compensation means eliminates said compensation factor when said user interface approaches a rest position.

11. The exercise machine of claim 1 wherein said compensation means is responsive to said user input means to selectively vary said compensation factor.

12. The exercise machine of claim 11 wherein said compensation factor is varied to add to said electric motor torque output a factor that simulates at least of portion of the inertia of a simulated weight stack.

13. The exercise machine of claim 12 wherein said compensation factor additionally includes a linkage friction factor to compensate for at least a portion of the friction of said linkage means.

14. The exercise machine of claim 1 wherein said compensation factor includes a motor friction factor to compensate for at least a portion of the friction of said electric motor.

15. The exercise machine of claim 12 wherein said compensation factor additionally includes a motor friction factor to compensate for at least a portion of the friction of said electric motor.

16. The exercise machine of claim 14 wherein said compensation factor additionally includes a linkage friction factor to compensate for at least a portion of the friction of said linkage means.

17. The exercise machine of claim 14 wherein said control means additionally includes a motion means for detecting a forward stroke and a return stroke of said user interface and wherein said motor friction factor is effective to reduce the torque output of said electric motor during said forward stroke.

18. The exercise machine of claim 17 wherein said motor friction factor is effective to add to the torque output of said electric motor during said return stroke.

19. The exercise machine of claim 17 wherein said compensation means eliminates said motor friction factor when said user interface approaches a rest position.

20. The exercise machine of claim 14 wherein said control means additionally includes position mean for detecting the positions of said user interface and wherein said compensation means eliminates said compensation factor when said user interface approaches a rest position.

21. The exercise machine of claim 1 wherein said control means additionally includes position means for detecting the positions of said user interface and wherein said compensation means eliminates said compensation factor when said user interface approaches a rest position.

22. An exercise machine comprising:
a user interface;
an electric motor;
linkage means for mechanically connecting said user interface to said electric motor;
control means operatively connected to said electric motor for controlling the torque output of said electric motor simulate a plurality of weights;
user input means operatively connected to said control means for permitting a user to operate the exercise machine; and
compensation means operatively connected to said control means for automatically varying said torque output by a compensation factor to compensate for at least a portion of the inertia of said electric motor in response to said control input.

23. The exercise machine of claim 22 wherein said compensation factor increases as a function of an increase in said simulated weights to be simulated by said electric motor torque output.

24. The exercise machine of claim 23 wherein said compensation factor is effective to subtract from the torque output of said electric motor for minimizing said simulated weights and is effective to add to the torque output of said electric motor for maximizing said simulated weights.

25. The exercise machine of claim 22 wherein said compensation factor additionally compensates for at least a portion of the inertia of said linkage means.

26. The exercise machine of claim 25 wherein said compensation factor increases as a function of an increase in said weight to be simulated by said torque output.

27. The exercise machine of claim 26 wherein said compensation factor is effective to subtract from the torque output of said electric motor for minimizing said simulated weights and is effective to add to the torque output of said electric motor for maximizing said simulated weights.

28. The exercise machine of claim 22 wherein said compensation factor additionally compensates for at least a portion of the effects of gravity on said user interface.

29. The exercise machine of claim 28 additionally including position means operatively connected to said user interface and to said compensation means for generating a position signal representing the position of said user interface and wherein said compensation means varies said compensation factor as a function of the position of said user interface.

30. The exercise machine of claim 22 wherein said compensation means includes means for eliminating said compensation factor when said user interface approaches a rest position.

31. An exercise machine comprising:
a user interface;
an electric motor;
linkage means for mechanically connecting said user interface to said electric motor;
control means operatively connected to said electric motor for controlling the torque output of said electric motor; and
compensation means operatively connected to said control means for generating a compensation factor for varying said torque output to compensate for at least a portion of the mechanical friction of the exercise machine.

32. The exercise machine of claim 31 wherein said compensation factor compensates for at least a portion of the friction of said electric motor and said linkage means.

33. The exercise machine of claim 32 wherein said compensation factor compensates for approximately 60% of the friction of said electric motor and said linkage means.

34. The exercise machine of claim 31 wherein said compensation means includes means for eliminating said compensation factor when said user interface approaches a rest position.

35. The exercise machine of claim 31 wherein said compensation factor additionally compensates for at least a portion of the effects of gravity on said user interface.

36. The exercise machine of claim 31 additionally including position means operatively connected to said user interface and to said compensation means for generating a position signal representing the position of said user interface and wherein said compensation means varies said compensation factor as a function of the position of said user interface.

37. An exercise machine comprising:
a user interface;
an electric motor;
linkage means for mechanically connecting said user interface to said electric motor;
control means operatively connected to said electric motor for controlling the torque output of said electric motor; and
compensation means operatively connected to said control means for generating a compensation factor for varying said torque output to compensate for at least a portion of the effects of gravity on said user interface.

38. The exercise machine of claim 37 additionally including position means operatively connected to said user interface and to said compensation means for generating a position signal representing the position of said user interface and wherein said compensation means varies said compensation factor in response to said position signal.

39. The exercise machine of claim 38 wherein said mechanical characteristics of the exercise machine include the inertia characteristics of the exercise machine.

40. The exercise machine of claim 39 wherein said mechanical characteristics of the exercise machine include the friction of said user interface, said electric motor and said linkage means of the exercise machine.

41. An exercise machine comprising
a user interface;
an electric motor;
linkage means for mechanically connecting said user interface to said electric motor;
control means operatively connected to said electric motor for controlling the torque output of said electric motor; and
position means operatively connected to said control means for detecting the position of said user interface;
compensation means operatively connected to said control means for varying the torque output of said motor by a compensation factor to compensate for at least a portion of the mechanical characteristics of the exercise machine.

42. The exercise machine of claim 41 wherein said mechanical characteristis of the exercise machine include the friction of said user interface, said electric motor and said linkage means of the exercise machine.

43. The exercise machine of claim 41 wherein said compensation factor is eliminated when said user interface approaches a predetermined position.

44. The exercise machine of claim 43 wherein said predetermined position is a rest position.

45. An exercise machine comprising:
a user interface;
an electric motor;
linkage means for mechanically connecting said user interface to said electric motor;
control means operatively connected to said electric motor for controlling the torque output of said electric motor to simulate a weight stack;
direction means operatively connected to said user interface and said control means for determining whether said user interface is moving in a first or a second direction; and
heavy negative means responsive to said direction means for causing said control means to increase said torque output by a first predetermined amount when said user interface is moving in said second direction.

46. The exercise machine of claim 45 wherein said heavy negative means increases said torque output by said first predetermined amount over a predetermined displacement when said user interface begins to move in said second direction.

47. The exercise machine of claim 46 wherein said heavy negative means causes said control means to decrease said torque output by a second predetermined amount after said user interface has stopped moving in said second direction.

48. The exercise machine of claim 47 wherein said heavy negative means decreases said torque output by said second predetermined amount after said user interface has stopped and begins to move in said first direction.

49. The exercise machine of claim 48 wherein said heavy negative means decreases said torque output by said second predetermined amount over a predetermined displacement when said user interface begins to move in said first direction.

50. The exercise machine of claim 48 wherein said first predetermined amount is substantially equal to said second predetermined amount.

51. An exercise machine comprising;
a user interface;
an electric motor;
linkage means for mechanically connecting said user interface to said electric motor;
control means operatively connected to said electric motor for controlling the torque output of said electric motor; and
test means operatively connected to said user interface and said control means for measuring the strength of a user.

52. The exercise machine of claim 51 wherein said test means includes displacement means for measuring the displacement of said user interface and wherein said test means increases the torque output as a function of increasing displacement of said user interface.

53. The exercise machine of claim 52 wherein said test means generates a maximum strength signal when the displacement of said user interface has stopped.

54. An exercise machine comprising:
a user interface;
an electric motor;
linkage means for mechanically connecting said user interface to said electric motor;
control means operatively connected to said electric motor for controlling the torque output of said electric motor in order to provide a user opposition force;
user input means operatively connected to said control means for permitting a user to operate the machine; and
stroke means operatively connected to said control means for permitting the user to set a maximum displacement point of said user interface of a series of repetitions, each having a forward stroke and a return stroke by moving said user interface during the first repetition of said series.

55. The exercise machine of claim 54 wherein said control means includes a digital computer having a memory and said stroke means is effective to store in said memory a value representing the furthest displacement point of said user interface during said forward stroke of said first repetition.

56. The exercise machine of claim 55 wherein said stroke means is effective to store in said memory a value representing the displacement point of said user interface at the end of said return stroke of said first repetition.

57. The exercise machine of claim 56 wherein said control means applies a predetermined torque output to said user interface between said furthest displacement point during said forward stroke and said displacement point at said end of said return stroke.

58. The exercise machine of claim 57 wherein said stroke means responds to said user input means to move said user interface means from a rest position to a predetermined point prior to said first stroke.

59. An exercise machine comprising:
a user interface;
an electric motor;
linkage means for mechanically connecting said user interface to said electric motor;
control means operatively connected to said electric motor for controlling the torque output of said electric motor;
user input means operatively connected to said control means for permitting the user to operate the exercise machine; and
preposition means operatively connected to said control means for moving said user interface from a rest position to a preset position before initiation of an exercise program.

60. The exercise machine of claim 59 wherein said control means includes a digital computer having a memory storing said preset position and said preposition means responds to said user input means to move said user interface to said preset positions.

61. The exercise machine of claim 60 wherein said control means controls said output torque so as to move said user interface to said preset position at a substantially constant velocity.

62. An exercise machine comprising:
a user interface;
an electric motor;
linkage means for mechanically connecting said user interface to said electric motor;
control means operatively connected to said electric motor for controlling the torque output of said electric motor to generate a user opposition force;
user input means operatively connected to said control means for generating and storing in said control means a strength curve including said user opposition forces measured during a selected portion of the displacement of said user interface wherein said control means moves said user interface at a constant rate during the selected portion of the displacement of said user interface during which said user opposition forces are measured; and
exercise means operatively connected to said control means for controlling said torque output to functionally correspond to said strength curve.

63. The exercise machine of claim 62 wherein said exercise means controls said torque output to equal a predetermined percentage below said measured user opposition force.

64. The exercise machine of claim 63 wherein said selected portions is a forward stroke of an exercise.

65. The exercise machine of claim 64 wherein said exercise means controls said torque output to functionally correspond to said strength curve during a forward stroke of an exercise.

66. The exercise machine of claim 64 additionally including display means operatively connected to said control means for providing a graphic display of said stored strength curves.

67. The exercise machine of claim 63 wherein said predetermined percentage is approximately 70%.

68. The exercise machine of claim 62 additionally including display means operatively connected to said control means for providing a graphic display of said stored strength.

69. An exercise machine comprising:

a user interface;
an electric motor;
linkage means for mechanically connecting said user interface to said electric motor;
control means operatively connected to said electric motor for controlling the torque output of said electric motor;
user input means operatively connected to said control means for permitting the user to operate the exercise machine;
a memory operatively connected to said control means storing a plurality of strength curves wherein said strength curves represent the maximum force that the user is able to exert against said user interface at each point of displacement of said user interface;
customized strength exercise means operatively connected to said control means and responsive to said user input means for controlling said torque output to functionally correspond to one of said strength curves selected by the user.

70. The exercise machine of claim 69 wherein a first of said stored strength curves is generally representative of male strength curves and a second of said stored strength curves is generally representative of female strength curves.

71. The exercise machine of claim 70 wherein a third of said stored strength curves is generally representative of the user's strength curve.

72. The exercise machine of claim 70 wherein more than one of said stored strength curves relate to a single user.

73. The exercise machine of claim 69 additionally including display means operatively connected to said control means for providing a graphic display of said stored strength curves.

74. The exercise machine of claim 69 wherein said torque output is controlled to be a predetermined percentage below said maximum force.

75. In an exercise machine having a user interface engaged by a user to exert a force, means for exerting against the user a counterforce simulating a weight stack comprising:
a D.C. motor providing a counterforce against the user, said D.C. motor imparting rotation to a shaft coupled to the user interface to transmit the counterforce provided by said D.C. motor;
means for providing a force signal coupled to said D.C. motor to control the motor to provide said counterforce of a predetermined level;
means for sensing the speed of the shaft to provide a shaft speed signal proportional thereto;
inertia correction means responsive to said shaft speed signal for providing an inertia compensation signal to compensate for the inertia of said D.C. motor; and
means for combining said force signal and said inertia compensation signal to provide a control signal coupled to said D.C. motor to control the counterforce exerted thereby.

76. The exercise machine of claim 75 wherein said inertia correction means includes means for differentiating said shaft speed signal and means for scaling said differentiated shaft speed signal by a constant to generate said inertia compensation signal.

77. The exercise machine of claim 75 further including friction correction means responsive to said shaft speed signal for providing a friction compensation signal to compensate for the friction of said D.C. motor, said friction compensation signal being combined by said combining means with said force signal and said inertia compensation signal to provide said control signal to said D.C. motor.

78. The exercise machine of claim 77 wherein said inertia correction means includes means for differentiating said shaft speed signal and means for scaling said differentiated shaft speed signal by a constant to generate said inertia compensation signal and said friction correction means includes means responsive to said shaft speed signal for sensing the direction of rotation of said shaft to provide a positive direction signal in response to sensed rotation of the shaft in a first direction and a negative direction signal in response to sensed rotation of the shaft in a second direction and means for scaling said direction signal by a constant to generate said friction compensation signal.

79. In an exercise machine having a user interface engaged by a user to exert a force, means for exerting against the user a counterforce simulating a weight stack comprising:
a D.C. motor providing a counterforce against the user, said D.C. motor imparting rotation to a shaft coupled to the user interface to transmit the counterforce provided by said D.C. motor;
means for providing a force signal coupled to said D.C. motor to control said D.C. motor to provide said counterforce of a predetermined level;
means for sensing the speed of the shaft to provide a shaft speed signal proportional thereto;
friction correction means responsive to said shaft speed signal for providing a friction compensation signal to compensate for the friction of said D.C. motor; and
means for combining said force signal and said friction compensation signal to provide a control signal coupled to said D.C. motor to control the counterforce exerted thereby.

80. The exercise machine of claim 79 wherein said friction correction means includes means responsive to said shaft speed signal for sensing the direction of rotation of said shaft to provide a positive direction signal in response to sensed rotation of the shaft in a first direction and a negative direction signal in response to sensed rotation of the shaft in a second direction and means for scaling said direction signal by a constant to provide said friction compensation signal.

81. In an exercise machine having a user interface engaged by a user to exert a force, means for exerting against the user a counterforce simulating a weight stack comprising:
a D.C. motor providing a counterforce against the user, said D.C. motor imparting rotation to a shaft coupled to the user interface to transmit the counterforce provided by said D.C. motor;
user input means operable by the user to select the level of the counterforce;
means coupled to said shaft for sensing the displacement of the user interface;
programmable processing means responsive to said user input means and said displacement sensing means for providing a force signal coupled to said D.C. motor to control said D.C. motor to provide a predetermined counterforce;
means for sensing the speed of the shaft to provide a shaft speed signal proportional thereto;

inertia correction means responsive to said shaft speed signal for providing an inertia compensation signal to compensate for the inertia of said D.C. motor;

means for combining said force signal and said inertia compensation signal to provide a control signal coupled to said D.C. motor to control the counterforce exerted thereby; and means responsive to said processing means for preventing said inertia compensation signal from being combined with said force signal near zero displacement of said user interface.

82. The exercise machine of claim 81 further including friction correction means responsive to said shaft speed signal for providing a friction compensation signal to compensate for the friction of said D.C. motor, said friction compensation signal being combined by said combining means with said force signal and said inertia compensation signal to provide said control signal to said D.C. motor.

83. In an exercise machine having a user interface engaged by a user to exert a force, means for exerting against the user a counterforce simulating a weight stack comprising:

a D.C. motor providing a counterforce against the user, said D.C. motor imparting rotation to a shaft coupled to the user interface to transmit the counterforce provided by said D.C. motor;

user input means operable by the user to select the level of the counterforce;

means coupled to said shaft for sensing the displacement of the user interface;

programmable processing means responsive to said user input means and said displacement sensing means for providing a force signal coupled to said D.C. motor to control said D.C. motor to provide a predetermined counterforce;

means for sensing the speed of the shaft to provide a shaft speed signal proportional thereto;

friction correction means responsive to said shaft speed signal for providing a friction compensation signal to compensate for the friction of said D.C. motor; and means for combining said force signal and said friction compensation signal to provide a control signal coupled to said D.C. motor to control the counterforce exerted thereby.

84. In an exercise machine having a user interface engaged by a user to exert a force, means for exerting against the user a counterforce simulating a weight stack comprising:

a D.C. motor coupled to the user interface for providing a counterforce against the user;

input means operable by the user for selecting the level of difficulty of an exercise formed of a plurality of repetitions;

programmable processing means responsive to said input means for controlling the amount of counterforce provided by said D.C. motor to provide said exercise formed of a progressive phase in which the counterforce is gradually increased from a starting level to a plateau level over a first group of repetitions followed by a plateau phase in which the counterforce is maintained constant at the plateau level over a second group of repetitions followed by a regressive phase in which the counterforce is gradually decreased from the plateau level to the starting level over a third group of repetitions wherein said processing means varies the magnitude of the plateau level counterforce and the number of different progressive level and regressive level repetitions in said exercise in response to the difficulty level selected such that as the level of difficulty increases, the magnitude of the plateau level counterforce and the number of different counterforces applied during the progressive and regressive levels increase.

85. The exercise machine of claim 84 wherein said processing means further varies the number of plateau level repetitions in said exercise in response to the difficulty level selected such that as the difficulty level increases, the number of plateau level repetitions decreases.

86. The exercise machine of claim 84 wherein said input means is operable by said user to select a maximum counterforce value and said processing means is responsive to the selected maximum counterforce value to increase the counterforce exerted against the user from said starting level of 50% of the selected maximum counterforce value during the progressive phase.

87. The exercise machine of claim 86 wherein said processing means is responsive to the selected maximum counterforce value and to the selected level of difficulty to provide said plateau level of approximately 70% of the selected maximum counterforce value during a low difficulty level exercise, to provide said plateau level of approximately 80% of the selected maximum counterforce value during an intermediate difficulty level exercise, and to provide said plateau level of approximately 90% of the selected maximum counterforce value during a high difficulty level exercise.

88. The exercise machine of claim 84 further including means for automatically measuring the maximum counterforce value which can be opposed by the user and wherein said processing means is responsive to the measured maximum counterforce value to increase the counterforce exerted against the user from said starting level of 50% of the measured maximum counterforce value during the progressive phase.

89. The exercise machine of claim 88 wherein said processing means is responsive to the measured maximum counterforce value and to the selected level of difficulty to provide said plateau level of approximately 70% of the measured maximum counterforce value during a low difficulty level exercise, to provide said plateau level of approximately 80% of the measured maximum counterforce value during an intermediate difficulty level exercise, and to provide said plateau level of approximately 90% of the measured maximum counterforce value during a high difficulty level exercise.

90. The exercise machine of claim 84 further including means for sensing the displacement of the user interface and wherein each repetition includes a forward stroke and a return stroke; said input means is operable by said user to select a maximum forward stroke counterforce and a maximum return stroke counterforce; and said processing means is responsive to the displacement sensing means and said selected maximum counterforce values to provide during the return stroke of each repetition said counterforce which is a given percentage of the selected forward stroke counterforce and to provide during the return stroke of each repetition a counterforce which increases the given percentage of the selected return stroke counterforce gradually over a given displacement of the user interface.

91. The exercise machine of claim 84 further including means for sensing the displacement of the user interface and means for measuring the maximum counterforce which can be opposed by the user, said processing means being responsive to the displacement sensing means and the measuring means for providing during the forward stroke of each repetition said counterforce with a first value which is a predetermined percentage of the measured maximum counterforce and during the return stroke of each repetition providing said counterforce with a second value which increases to 1.5 times said predetermined percentage of the measured maximum counterforce.

* * * * *

UNITED STATES PATENT AND TRADEMARK OFFICE

CERTIFICATE OF CORRECTION

PATENT NO. : 5,020,794

DATED : June 4, 1991

INVENTOR(S) : William H. Englehardt et al.

It is certified that error appears in the above-identified patent and that said Letters Patent is hereby corrected as shown below:

Column 1, lines 22 and 23, change "pullerys" to -- pulleys --

Column 1, line 26, change "lifing" to -- lifting --

Column 2, line 13, change "componets" to -- components --

Column 4, line 32, change "when" to -- which --

Column 4, line 34, change "repetions" to -- repetitions --

Column 7, line 2, change "1 82 f" to -- 1μf --

Column 7, line 56, change "100-1/3" to -- 100Ω --

Column 7, line 58, change "K-1/3" to -- KΩ --

Column 7, line 66, change "mode" to -- node --

Column 8, line 3, change "froms" to -- forms --

Column 8, line 45, change "ofthe" to -- of the --

Column 8, line 48, after "motor's" insert -- 30 --

UNITED STATES PATENT AND TRADEMARK OFFICE

CERTIFICATE OF CORRECTION

PATENT NO. : 5,020,794

DATED : June 4, 1991

INVENTOR(S) : William H. Englehardt et al.

It is certified that error appears in the above-identified patent and that said Letters Patent is hereby corrected as shown below:

Column 9, line 38, change "40" to -- 4° --

Column 9, line 48, change "40" to -- 4° --

Column 10, line 45, change "22" to -- 222 --

Column 11, line 65, this paragraph is a continuation of the previous paragraph

Column 12, line 40, change "repetitions" to -- repetition --

Column 12, line 46, change "repetitions, of" to -- repetition, a --

Column 13, line 49, change "present" to -- preset --

Column 13, line 51, change "Preferrably" to -- Preferably --

Column 14, line 48, change "since" to -- Since --

UNITED STATES PATENT AND TRADEMARK OFFICE

CERTIFICATE OF CORRECTION

PATENT NO. : 5,020,794

DATED : June 4, 1991

INVENTOR(S) : William H. Englehardt et al.

It is certified that error appears in the above-identified patent and that said Letters Patent is hereby corrected as shown below:

Column 16, line 24, change "mean" to -- means --

Column 16, line 43, after "motor" insert -- to --

Column 18, line 34, change "characteristis" to -- characteristics --

Column 20, line 36, after "for" insert -- permitting a user to operate the exercise machines;

test means operatively connected to said control means for --

Signed and Sealed this

Ninth Day of June, 1992

*Attest:*

DOUGLAS B. COMER

*Attesting Officer*

*Acting Commissioner of Patents and Trademarks*